US008765340B2

(12) United States Patent
Vella et al.

(10) Patent No.: US 8,765,340 B2
(45) Date of Patent: Jul. 1, 2014

(54) FLUORINATED STRUCTURED ORGANIC FILM PHOTORECEPTOR LAYERS CONTAINING FLUORINATED SECONDARY COMPONENTS

(75) Inventors: Sarah J. Vella, Milton (CA); Matthew A. Heuft, Oakville (CA); Adrien P. Cote, Clarkson (CA); Paul Gerroir, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/572,095

(22) Filed: Aug. 10, 2012

(65) Prior Publication Data

US 2014/0045108 A1 Feb. 13, 2014

(51) Int. Cl.
*G03G 5/00* (2006.01)
*G03G 15/04* (2006.01)

(52) U.S. Cl.
USPC ..... 430/66; 430/56; 430/58.05; 430/58.74; 430/58.8; 399/159

(58) Field of Classification Search
USPC ..... 430/66, 58.75, 58.8; 399/159
See application file for complete search history.

(56) References Cited

U.S. PATENT DOCUMENTS

| | | | |
|---|---|---|---|
| 2,324,550 | A | 7/1943 | Wolfe |
| 3,430,418 | A | 3/1969 | Wagner |
| 3,801,315 | A | 4/1974 | Gundlach et al. |
| 4,078,927 | A | 3/1978 | Amidon et al. |
| 4,081,274 | A | 3/1978 | Horgan |
| 4,115,116 | A | 9/1978 | Stolka et al. |
| 4,233,384 | A | 11/1980 | Turner et al. |
| 4,257,699 | A | 3/1981 | Lentz |
| 4,265,990 | A | 5/1981 | Stolka et al. |
| 4,286,033 | A | 8/1981 | Neyhart et al. |
| 4,291,110 | A | 9/1981 | Lee |
| 4,299,897 | A | 11/1981 | Stolka et al. |
| 4,304,829 | A | 12/1981 | Limburg et al. |
| 4,306,008 | A | 12/1981 | Pai et al. |
| 4,338,387 | A | 7/1982 | Hewitt |
| 4,346,387 | A | 8/1982 | Hertz |
| 4,387,980 | A | 6/1983 | Ueno et al. |
| 4,457,994 | A | 7/1984 | Pai et al. |
| 4,464,450 | A | 8/1984 | Teuscher |
| 4,489,593 | A | 12/1984 | Pieters et al. |
| 4,493,550 | A | 1/1985 | Takekida |
| 4,664,995 | A | 5/1987 | Horgan et al. |

(Continued)

FOREIGN PATENT DOCUMENTS

| | | |
|---|---|---|
| CA | 2 753 863 | 9/2010 |
| CA | 2 753 891 | 9/2010 |

(Continued)

OTHER PUBLICATIONS

Jun. 10, 2013 Notice of Allowance issued in U.S. Appl. No. 13/351,589.

(Continued)

*Primary Examiner* — Thorl Chea
(74) *Attorney, Agent, or Firm* — Pillsbury Winthrop Shaw Pittman LLP

(57) ABSTRACT

A imaging member, such as a photoreceptor, having an outermost layer that is a structured organic film (SOF) comprising a plurality of segments and a plurality of linkers including a first fluorinated segment, a second electroactive segment and fluorinated secondary components.

19 Claims, 6 Drawing Sheets

(56) References Cited

U.S. PATENT DOCUMENTS

| | | | |
|---|---|---|---|
| 4,855,203 | A | 8/1989 | Badesha et al. |
| 4,871,634 | A | 10/1989 | Limburg et al. |
| 4,917,711 | A | 4/1990 | Xie et al. |
| 4,921,769 | A | 5/1990 | Yuh et al. |
| 4,921,773 | A | 5/1990 | Melnyk et al. |
| 4,996,125 | A | 2/1991 | Sakaguchi et al. |
| 5,017,432 | A | 5/1991 | Eddy et al. |
| 5,061,965 | A | 10/1991 | Ferguson et al. |
| 5,110,693 | A | 5/1992 | Friend et al. |
| 5,139,910 | A | 8/1992 | Law et al. |
| 5,165,909 | A | 11/1992 | Tennent et al. |
| 5,166,031 | A | 11/1992 | Badesha et al. |
| 5,231,162 | A | 7/1993 | Nagata |
| 5,281,506 | A | 1/1994 | Badesha et al. |
| 5,300,271 | A | 4/1994 | Golden et al. |
| 5,366,772 | A | 11/1994 | Badesha et al. |
| 5,368,913 | A | 11/1994 | Ortega |
| 5,368,967 | A | 11/1994 | Schank et al. |
| 5,370,931 | A | 12/1994 | Fratangelo et al. |
| 5,432,539 | A | 7/1995 | Anderson |
| 5,455,136 | A | 10/1995 | Yu et al. |
| 5,456,897 | A | 10/1995 | Moy et al. |
| 5,500,200 | A | 3/1996 | Mandeville et al. |
| 5,569,635 | A | 10/1996 | Moy et al. |
| 5,658,702 | A | 8/1997 | Nukada |
| 5,702,854 | A | 12/1997 | Schank et al. |
| 5,707,916 | A | 1/1998 | Snyder et al. |
| 5,853,906 | A | 12/1998 | Hsieh |
| 5,877,110 | A | 3/1999 | Snyder et al. |
| 5,976,744 | A | 11/1999 | Fuller et al. |
| 6,002,907 | A | 12/1999 | Berkes |
| 6,020,426 | A | 2/2000 | Yamaguchi et al. |
| 6,046,348 | A | 4/2000 | Yamada et al. |
| 6,107,117 | A | 8/2000 | Bao et al. |
| 6,107,439 | A | 8/2000 | Yanus et al. |
| 6,248,686 | B1 | 6/2001 | Inagaki et al. |
| 6,340,382 | B1 | 1/2002 | Baksh et al. |
| 6,464,756 | B1 | 10/2002 | Plee |
| 6,505,921 | B2 | 1/2003 | Chwalek et al. |
| 6,819,244 | B2 | 11/2004 | Dukler et al. |
| 7,067,687 | B2 | 6/2006 | Pinnavaia et al. |
| 7,177,572 | B2 | 2/2007 | DiRubio et al. |
| 7,196,210 | B2 | 3/2007 | Yaghi et al. |
| 7,202,002 | B2 | 4/2007 | Tokarski et al. |
| 7,384,717 | B2 | 6/2008 | Dinh et al. |
| 7,416,824 | B2 | 8/2008 | Kondoh et al. |
| 7,560,205 | B2 | 7/2009 | Qi et al. |
| 7,582,798 | B2 | 9/2009 | Yaghi et al. |
| 7,799,495 | B2 | 9/2010 | Wu et al. |
| 8,065,904 | B1 | 11/2011 | Allendorf et al. |
| 8,093,347 | B2 | 1/2012 | Heuft et al. |
| 8,119,314 | B1 | 2/2012 | Heuft et al. |
| 8,119,315 | B1 | 2/2012 | Heuft et al. |
| 8,313,560 | B1 | 11/2012 | Cote et al. |
| 8,334,360 | B2 | 12/2012 | Heuft et al. |
| 2002/0098346 | A1 | 7/2002 | Yitzchaik |
| 2003/0054948 | A1 | 3/2003 | Pinnavaia et al. |
| 2003/0099845 | A1 | 5/2003 | Ogawa et al. |
| 2003/0126989 | A1 | 7/2003 | Bancon et al. |
| 2003/0172808 | A1 | 9/2003 | Le Bec |
| 2004/0147664 | A1 | 7/2004 | Lee et al. |
| 2004/0171482 | A1 | 9/2004 | Pinnavaia et al. |
| 2004/0244865 | A1 | 12/2004 | Jung et al. |
| 2005/0017633 | A1 | 1/2005 | Miyadera |
| 2005/0257685 | A1 | 11/2005 | Baksh et al. |
| 2005/0260443 | A1 | 11/2005 | Marks et al. |
| 2006/0046169 | A1 | 3/2006 | Shoshi |
| 2006/0097393 | A1 | 5/2006 | Uchimaru et al. |
| 2006/0154807 | A1 | 7/2006 | Yaghi et al. |
| 2006/0182993 | A1 | 8/2006 | Ogata et al. |
| 2006/0204742 | A1 | 9/2006 | Gronbeck et al. |
| 2006/0236862 | A1 | 10/2006 | Golden et al. |
| 2007/0123606 | A1 | 5/2007 | Toma et al. |
| 2007/0287220 | A1 | 12/2007 | Jeong et al. |
| 2008/0107980 | A1 | 5/2008 | De Jong et al. |
| 2008/0108777 | A1* | 5/2008 | Davis et al. ..... 528/196 |
| 2008/0132669 | A1 | 6/2008 | Eriguchi et al. |
| 2008/0233343 | A1 | 9/2008 | Cheng et al. |
| 2008/0268135 | A1 | 10/2008 | Yokoyama et al. |
| 2008/0316247 | A1 | 12/2008 | Cellura et al. |
| 2009/0025555 | A1 | 1/2009 | Lively et al. |
| 2009/0046125 | A1 | 2/2009 | Nystrom et al. |
| 2009/0053417 | A1 | 2/2009 | Mino |
| 2009/0117476 | A1 | 5/2009 | Heuft et al. |
| 2009/0149565 | A1 | 6/2009 | Liu et al. |
| 2009/0208857 | A1 | 8/2009 | Wu et al. |
| 2009/0274490 | A1 | 11/2009 | Anderson et al. |
| 2010/0015540 | A1 | 1/2010 | Dinh et al. |
| 2010/0068635 | A1 | 3/2010 | Tanaka |
| 2010/0143693 | A1 | 6/2010 | Yaghi et al. |
| 2010/0224867 | A1 | 9/2010 | Heuft et al. |
| 2010/0227071 | A1 | 9/2010 | Heuft et al. |
| 2010/0227998 | A1 | 9/2010 | Heuft et al. |
| 2010/0228025 | A1* | 9/2010 | Cote et al. ..... 544/71 |
| 2010/0240781 | A1 | 9/2010 | Cooper et al. |
| 2011/0011128 | A1 | 1/2011 | Grover |
| 2011/0030555 | A1 | 2/2011 | Jonschker et al. |
| 2011/0053064 | A1* | 3/2011 | Kim et al. ..... 430/56 |
| 2011/0076605 | A1 | 3/2011 | Doi et al. |
| 2011/0236301 | A1 | 9/2011 | Kang et al. |
| 2012/0029236 | A1 | 2/2012 | Cote et al. |
| 2012/0031268 | A1 | 2/2012 | Yaghi et al. |
| 2012/0040282 | A1 | 2/2012 | Heuft et al. |
| 2012/0040283 | A1 | 2/2012 | Heuft et al. |
| 2012/0152117 | A1 | 6/2012 | Lively et al. |

FOREIGN PATENT DOCUMENTS

| | | | |
|---|---|---|---|
| CA | 2 753 940 | | 9/2010 |
| CA | 2 753 945 | | 9/2010 |
| DE | 10 2008 011 840 | A1 | 9/2009 |
| EP | 0312376 | A2 | 4/1989 |
| JP | 9 087849 | A | 3/1997 |
| WO | WO 91/15813 | | 10/1991 |
| WO | WO 2006/064892 | A1 | 6/2006 |
| WO | WO 2007/090864 | A1 | 8/2007 |
| WO | WO 2007/098263 | A2 | 8/2007 |
| WO | WO 2008/091976 | A1 | 7/2008 |
| WO | WO 2009/022187 | A1 | 2/2009 |
| WO | WO 2009/127896 | A1 | 10/2009 |
| WO | WO 2010/102018 | A1 | 9/2010 |
| WO | WO 2010/102025 | A1 | 9/2010 |
| WO | WO 2010/102027 | A1 | 9/2010 |
| WO | WO 2010/102036 | A1 | 9/2010 |
| WO | WO 2010/102038 | A1 | 9/2010 |
| WO | WO 2010/102043 | A1 | 9/2010 |

OTHER PUBLICATIONS

Apr. 5, 2013 Canadian Office Action issued in Canadian Patent Application No. 2,769,976.

R.J. Jeng et al. "Low Loss Second-Order Nonlinear Optical Polymers Based on All Organic Sol-Gel Materials," Journal of Applied Polymer Science, Jan. 10, 1995, pp. 209-214, vol. 55, No. 2, John Wiley & Sons, Inc.

Apr. 9, 2013 European Office Action issued in European Patent Application No. 10 749 274.

Apr. 9, 2013 European Office Action issued in European Patent Application No. 10 749 276.

Apr. 9, 2013 European Office Action issued in European Patent Application No. 10 749 285.

Apr. 9, 2013 European Office Action issued in European Patent Application No. 10 749 283.

Apr. 9, 2013 European Office Action issued in European Patent Application No. 10 749 278.

Mar. 1, 2013 Chinese Office Action issued in Chinese Patent Application No. 201080019043.4 (with translation).

Mar. 29, 2013 Chinese Office Action issued in Chinese Patent Application No. 201080019368.2 (with translation).

Oct. 31, 2012 Search Report issued in GB1217201.1.

Jan. 3, 2013 Notice of Allowance issued in U.S. Appl. No. 13/182,047.

(56) References Cited

OTHER PUBLICATIONS

Shun Wan et al., "A Belt-Shaped, Blue Luminescent, and Semiconducting Covalent Organic Framework," Angew. Chem. Int. Ed., vol. 47, pp. 8826-8830 (published on web Jan. 10, 2008).
Nikolas A. A. Zwaneveld et al., "Organized Formation of 2D Extended Covalent Organic Frameworks at Surfaces," *J. Am. Chem. Soc.*, vol. 130, pp. 6678-6679 (published on web Apr. 30, 2008).
Adrien P. Cote et al., "Porous, Crystalline, Covalent Organic Frameworks," *Science*, vol. 310, pp. 1166-1170 (Nov. 18, 2005).
Hani El-Kaderi et al., "Designed Synthesis of 3D Covalent Organic Frameworks," *Science*, vol. 316, pp. 268-272 (Apr. 13, 2007).
Adrien P. Cote et al., "Reticular Synthesis of Microporous and Mesoporous Covalent Organic Frameworks" *J. Am. Chem. Soc.*, vol. 129, 12914-12915 (published on web Oct. 6, 2007).
Omar M. Yaghi et al., "Reticular synthesis and the design of new materials," *Nature*, vol. 423, pp. 705-714 (Jun. 12, 2003).
Nathan W. Ockwig et al., "Reticular Chemistry: Occurrence and Taxonomy of Nets and Grammar for the Design of Frameworks," *Acc. Chem. Res.*, vol. 38, No. 3, pp. 176-182 (published on web Jan. 19, 2005).
Pierre Kuhn et al., "Porous, Covalent Triazine-Based Frameworks Prepared by Ionothermal Synthesis," *Angew. Chem. Int. Ed.*, vol. 47, pp. 3450-3453. (Published on web Mar. 10, 2008).
Jia-Xing Jiang et al., "Conjugated Microporous Poly(aryleneethylnylene) Networks," *Angew. Chem. Int. Ed.*, vol. 46, (2008) pp. 1-5 (Published on web Sep. 26, 2008).
Hunt, J.R. et al. "Reticular Synthesis of Covalent-Organic Borosilicate Frameworks" *J. Am. Chem. Soc.*, vol. 130, (2008), 11872-11873. (published on web Aug. 16, 2008).
Apr. 28, 2010 International Search Report issued in PCT/US 10/26082.
Apr. 28, 2010 Written Opinion issued in PCT/US 10/26082.
Apr. 27, 2010 International Search Report issued in PCT/US 10/26071.
Apr. 27, 2010 Written Opinion issued in PCT/US 10/26071.
Apr. 28, 2010 International Search Report issued in PCT/US 10/26091.
Apr. 28, 2010 Written Opinion issued in PCT/US 10/26091.
Apr. 28, 2010 International Search Report issued in PCT/US 10/26100.
Apr. 28, 2010 Written Opinion issued in PCT/US 10/26100.
Apr. 16, 2010 International Search Report issued in PCT/US 10/26079.
Apr. 16, 2010 Written Opinion issued in PCT/US 10/26079.
Apr. 20, 2010 International Search Report issued in PCT/US 10/26094.
Apr. 20, 2010 Written Opinion issued in PCT/US 10/26094.
U.S. Appl. No. 12/716,571, filed Mar. 3, 2010 Matthew A. Heuft et al.
U.S. Appl. No. 12/716,524, filed Mar. 3, 2010 Matthew A. Heuft et al.
U.S. Appl. No. 12/716,324, filed Mar. 3, 2010 Matthew A. Heuft et al.
U.S. Appl. No. 12/716,686, filed Mar. 3, 2010 Matthew A. Heuft et al.
U.S. Appl. No. 12/716,449, filed Mar. 3, 2010 Adrien Pierre Cote et al.
Cassie, A.B.D. et al., "Wettability of Porous Surfaces," Trans. Faraday Soc., vol. 40, pp. 546-551, Jun. 1944.
U.S. Appl. No. 12/854,962, filed Aug. 12, 2010 Matthew A. Heuft et al.
U.S. Appl. No. 12/815,688, filed Jun. 15, 2010 Adrien P. Cote et al.
U.S. Appl. No. 12/854,957, filed Aug. 12, 2010 Matthew A. Heuft et al.
U.S. Appl. No. 12/845,053, filed Jul. 28, 2010 Adrien P. Cote et al.
U.S. Appl. No. 12/845,235, filed Jul. 28, 2010 Adrien P. Cote et al.
U.S. Appl. No. 12/566,568, filed Sep. 24, 2009 Eugene M. Chow et al.
U.S. Appl. No. 12/566,518, filed Sep. 24, 2009 Eugene M. Chow et al.
U.S. Appl. No. 12/716,706, filed Mar. 3, 2010 Adrien Pierre Cote et al.
U.S. Appl. No. 12/845,052, filed Jul. 28, 2010 Adrien Pierre Cote et al.
Colson et al. "Oriented 2D Covalent Organic Framework Thin Films on Single-Layer Graphene", *Science*, 332, 228-231 (2011).
K.S. Novoselov et al., "Electric Field Effect in Atomically Thin Carbon Films", *Science*, Oct. 22, 2004, pp. 666-669, vol. 306.
Stankovich et al., "Graphene-Based Composite Materials", *Nature*, Jul. 20, 2006, pp. 282-286, vol. 442.
U.S. Appl. No. 13/173,948, filed Jun. 30, 2011 Adrien Pierre Cote et al.
U.S. Appl. No. 13/042,950, filed Mar. 8, 2011 Adrien Pierre Cote et al.
U.S. Appl. No. 13/181,761, filed Jul. 13, 2011 Adrien Pierre Cote et al.
U.S. Appl. No. 13/181,912, filed Jul. 13, 2011 Adrien Pierre Cote et al.
U.S. Appl. No. 13/174,046, filed Jun. 30, 2011 Matthew A. Heuft et al.
Jun. 1, 2011 Office Action issued in U.S. Appl. No. 12/716,524.
U.S. Appl. No. 13/351,561, filed Jan. 17, 2012 Matthew A. Heuft et al.
U.S. Appl. No. 13/246,268, filed Sep. 27, 2011 Matthew A. Heuft et al.
U.S. Appl. No. 13/246,227, filed Sep. 27, 2011 Adrien Pierre Cote et al.
U.S. Appl. No. 13/351,589, filed Jan. 17, 2012 Matthew A. Heuft et al.
Nov. 14, 2011 Notice of Allowance issued in U.S. Appl. No. 12/854,957.
Nov. 14, 2011 Notice of Allowance issued in U.S. Appl. No. 12/854,962.
Sep. 26, 2011 Office Action issued in U.S. Appl. No. 12/854,962.
Sep. 27, 2011 Office Action issued in U.S. Appl. No. 12/854,957.
Nov. 21, 2011 Office Action issued in U.S. Appl. No. 12/815,688.
Feb. 7, 2012 Office Action issued in U.S. Appl. No. 13/173,948.
Sep. 19, 2011 Notice of Allowance issued in U.S. Appl. No. 12/716,524.
Mar. 29, 2012 Office Action issued in U.S. Appl. No. 12/845,235.
Apr. 6, 2012 Office Action issued in U.S. Appl. No. 13/315,452.
Peter M. Budd; "Putting Order into Polymer Networks"; Science, 2007, 316, 210-211.
Wan, S., Guo, J., Kim, J., Ihee, H. and Jiang, D.; "A Photoconductive Covalent Organic Framework: Self-Condensed Arene Cubes Composed of Eclipsed 2D Polypyrene Sheets for Photocurrent Generation"; Angewandte Chemie International Edition, 2009, 48, 5439-5442.
Jun. 19, 2012 German Search Report issued in Application No. 10 2011 079 277.5 (with translation).
Aug. 10, 2012 Notice of Allowance issued in U.S. Appl. No. 13/181,912.
Aug. 10, 2012 Office Action issued in U.S. Appl. No. 12/716,449.
Aug. 3, 2012 Office Action issued in U.S. Appl. No. 12/716,686.
Jul. 6, 2012 Office Action issued in U.S. Appl. No. 12/716,706.
Aug. 3, 2012 Office Action issued in U.S. Appl. No. 12/815,688.
Jun. 25, 2012 Office Action issued in U.S. Appl. No. 12/845,052.
Aug. 8, 2012 Office Action issued in U.S. Appl. No. 13/181,761.
U.S. Patent Application No. 13/571,933, filed Aug. 10, 2012, Sara J. Vella et al.
Aug. 3, 2012 Notice of Allowance issued in U.S. Appl. No. 12/845,053.
Extended European Search Report for European Patent Application No. 10749278.7 dated Aug. 8, 2012.
European Search Report for European Patent Application No. 10749283.7 dated Aug. 10, 2012.
European Search Report for European Patent Application No. 10749285.2 dated Aug. 6, 2012.
European Search Report for European Patent Application No. 10749276.1 dated Aug. 6, 2012.
European Search Report for European Patent Application No. 10749274.6 dated Aug. 6, 2012.
European Search Report for European Patent Application No. 10749289.4 dated Aug. 10, 2012.
Notice of Allowance for U.S. Appl. No. 13/315,452 mailed Aug. 15, 2012.
Sep. 6, 2012 Office Action issued in U.S. Appl. No. 13/182,047.
Sep. 6, 2012 Office Action issued in U.S. Appl. No. 12/716,324.
U.S. Appl. No. 13/804,874, filed Mar. 14, 2013 to Wigglesworth et al.

(56) References Cited

OTHER PUBLICATIONS

U.S. Appl. No. 13/748,114, filed Jan. 23, 2013 to Heuft et al.
Mar. 14, 2013 Office Action issued in U.S. Appl. No. 12/845,052.
U.S. Appl. No. 13/746,686, filed Jan. 22, 2013 to Cote et al.
Feb. 15, 2013 Office Action issued in U.S. Appl. No. 12/815,688.
Mar. 13, 2013 Office Action issued in U.S. Appl. No. 12/716,571.
Mar. 12, 2013 Notice of Allowance issued in U.S. Appl. No. 13/246,268.
Mar. 22, 2013 Office Action issued in U.S. Appl. No. 13/246,109.
Jan. 16, 2013 Notice of Allowance issued in U.S. Appl. No. 12/716,449.
Porous, Crystalline, Covalent Organic Framework, Cote, Nov. 18, 2005 vol. 310 Science http://www.sciencemag.org/content/310/5751/1166.full?sid=6bbe3427-6590-4387-afd9-5e4156547de4.
Feb. 1, 2013 Office Action issued in U.S. Appl. No. 13/351,589.
Pandey et al., Imine-Linked Microporous Polymer Organic Frameworks, Chem. Mater. 2010, 22, 4974-4979.
Sep. 19, 2013 Office Action issued in U.S. Appl. No. 13/042,950.
Aug. 26, 2013 Office Action issued in U.S. Appl. No. 12/845,052.
Aug. 29, 2013 Office Action issued in U.S. Appl. No. 12/716,571.
Oct. 1, 2013 Office Action issued in U.S. Appl. No. 13/571,933.
Aug. 5, 2013 Notice of Allowance issued in U.S. Appl. No. 13/748,114.

* cited by examiner

IDEAL ROD BUILDING BLOCK

IDEAL ROD BUILDING BLOCK

DISTORTED ROD BUILDING BLOCK

DISTORTED ROD BUILDING BLOCK

IDEAL TRIANGULAR BUILDING BLOCK

IDEAL TRIANGULAR BUILDING BLOCK

DISTORTED TRIANGULAR BUILDING BLOCK

DISTORTED TRIANGULAR BUILDING BLOCK

IDEAL TETRAHEDRAL BUILDING BLOCK

IDEAL TETRAHEDRAL BUILDING BLOCK

DISTORTED TETRAHEDRAL BUILDING BLOCK

DISTORTED TETRAHEDRAL BUILDING BLOCK

IDEAL SQUARE BUILDING BLOCK

DISTORTED SQUARE/TETRAHEDRAL BUILDING BLOCK

DISTORTED SQUARE/TETRAHEDRAL BUILDING BLOCK

FLUORINATED STRUCTURED ORGANIC FILM PHOTORECEPTOR LAYERS CONTAINING FLUORINATED SECONDARY COMPONENTS

CROSS-REFERENCE TO RELATED APPLICATIONS

This nonprovisional application is related to U.S. patent application Ser. Nos. 12/716,524; 12/716,449; 12/716,706; 12/716,324; 12/716,686; 12/716,571; 12/815,688; 12/845,053; 12/845,235; 12/854,962; 12/854,957; 12/845,052, 13/042,950, 13/173,948, 13/181,761, 13/181,912, 13/174,046, 13/182,047, 13/246,109, 13/246,227, and 13/246,268; and U.S. Provisional Application No. 61/157,411, the disclosures of which are totally incorporated herein by reference in their entireties.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating.

U.S. Pat. No. 7,384,717, discloses an electrophotographic imaging member comprising a substrate, a charge generating layer, a charge transport layer, and an overcoating layer, said overcoating layer comprising a cured polyester polyol or cured acrylated polyol film-forming resin and a charge transport material.

Disclosed in U.S. Pat. No. 4,871,634 is an electrostatographic imaging member containing at least one electrophotoconductive layer. The imaging member comprises a photogenerating material and a hydroxy arylamine compound represented by a certain formula. The hydroxy arylamine compound can be used in an overcoat with the hydroxy arylamine compound bonded to a resin capable of hydrogen bonding such as a polyamide possessing alcohol solubility.

Disclosed in U.S. Pat. No. 4,457,994 is a layered photosensitive member comprising a generator layer and a transport layer containing a diamine type molecule dispersed in a polymeric binder, and an overcoat containing triphenyl methane molecules dispersed in a polymeric binder.

The disclosures of each of the foregoing patents are hereby incorporated by reference herein in their entireties. The appropriate components and process aspects of the each of the foregoing patents may also be selected for the present SOF compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Although excellent toner images may be obtained with multilayered belt or drum photoreceptors, it has been found that as more advanced, higher speed electrophotographic copiers, duplicators, and printers are developed, there is a greater demand on print quality. The delicate balance in charging image and bias potentials, and characteristics of the toner and/or developer, must be maintained. This places additional constraints on the quality of photoreceptor manufacturing, and thus on the manufacturing yield.

Imaging members are generally exposed to repetitive electrophotographic cycling, which subjects the exposed charged transport layer or alternative top layer thereof to mechanical abrasion, chemical attack and heat. This repetitive cycling leads to gradual deterioration in the mechanical and electrical characteristics of the exposed charge transport layer. Physical and mechanical damage during prolonged use, especially the formation of surface scratch defects, is among the chief reasons for the failure of belt photoreceptors. Therefore, it is desirable to improve the mechanical robustness of photoreceptors, and particularly, to increase their scratch resistance, thereby prolonging their service life. Additionally, it is desirable to increase resistance to light shock so that image ghosting, background shading, and the like is minimized in prints.

Providing a protective overcoat layer is a conventional means of extending the useful life of photoreceptors. Conventionally, for example, a polymeric anti-scratch and crack overcoat layer has been utilized as a robust overcoat design for extending the lifespan of photoreceptors. However, the conventional overcoat layer formulation exhibits ghosting and background shading in prints. Improving light shock resistance will provide a more stable imaging member resulting in improved print quality.

Despite the various approaches that have been taken for forming imaging members, there remains a need for improved imaging member design, to provide improved imaging performance and longer lifetime, reduce human and environmental health risks, and the like.

The structured organic film (SOF) compositions described herein are exceptionally chemically and mechanically robust materials that demonstrate many superior properties to conventional photoreceptor materials and increase the photoreceptor life by preventing chemical degradation pathways caused by the xerographic process. Additionally, additives, such as PTFE, maybe added to the SOF overcoat composition of the present disclosure to improve the properties of the imaging member, such as a photoreceptor.

SUMMARY OF THE DISCLOSURE

There is provided in embodiments an imaging member including a substrate; a charge generating layer; a charge transport layer; and an optional overcoat layer, wherein the outermost layer is an imaging surface that comprises a structured organic film (SOF) comprising a plurality of segments and a plurality of linkers including a first fluorinated segment, a second electroactive segment and fluorinated secondary components.

BRIEF DESCRIPTION OF THE DRAWINGS

Other aspects of the present disclosure will become apparent as the following description proceeds and upon reference to the following figures which represent illustrative embodiments.

Unless otherwise noted, the same reference numeral in different Figures refers to the same or similar feature.

DETAILED DESCRIPTION

Figure 1A:
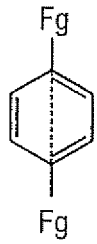
FIG. 1A-O are illustrations of exemplary building blocks whose symmetrical elements are outlined.
Figure 1B:
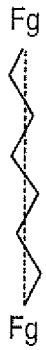
Figure 1C:
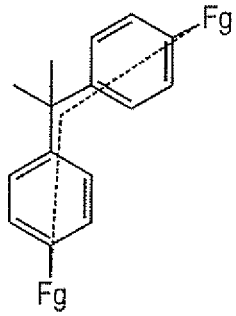
Figure 1D:
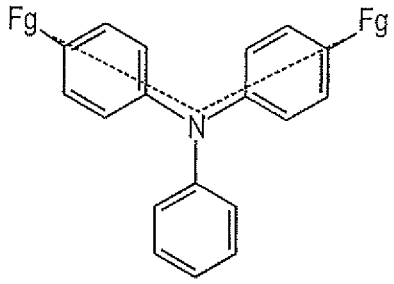
Figure 1E:
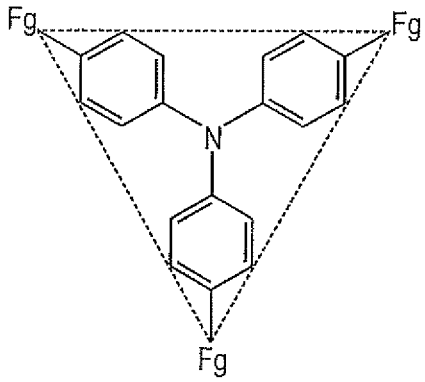
Figure 1F:
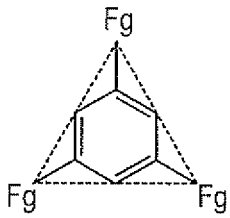
Figure 1G:
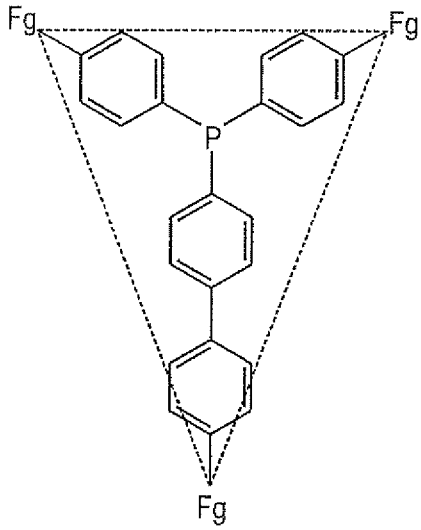
Figure 1H:
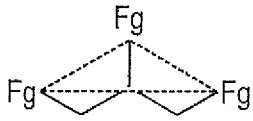
Figure 1I:
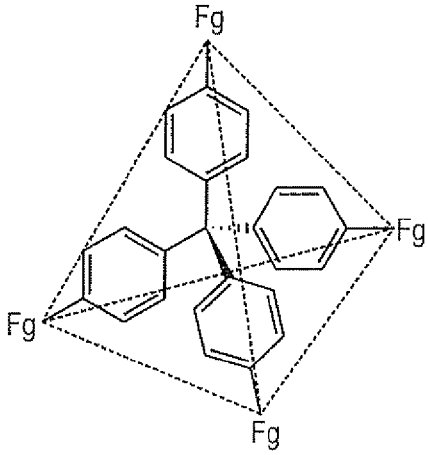
Figure 1J:
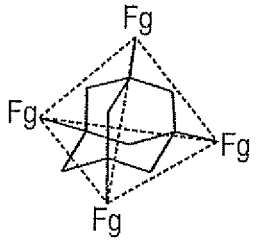
Figure 1K:
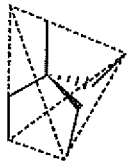
Figure 1L:
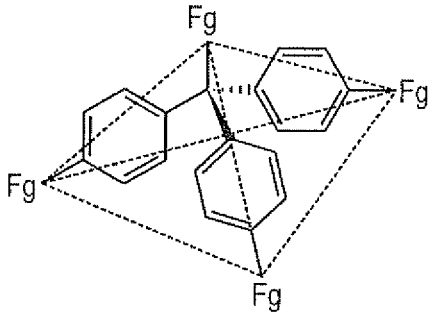
Figure 1M:
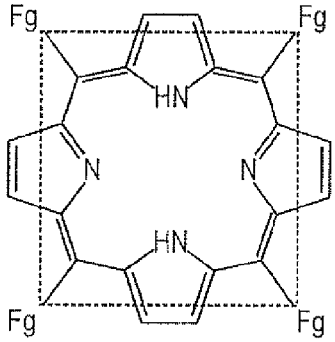
Figure 1N:
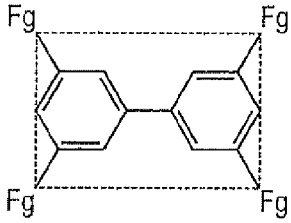

"Structured organic film" (SOF) refers to a COF that is a film at a macroscopic level. The imaging members of the present disclosure may comprise composite SOFs, which optionally may have a capping unit or group added into the SOF.

In this specification and the claims that follow, singular forms such as "a," "an," and "the" include plural forms unless the content clearly dictates otherwise.

The term "SOF" or "SOF composition" generally refers to a covalent organic framework (COF) that is a film at a macroscopic level. However, as used in the present disclosure the term "SOF" does not encompass graphite, graphene, and/or diamond. The phrase "macroscopic level" refers, for example, to the naked eye view of the present SOFs. Although COFs are a network at the "microscopic level" or "molecular level" (requiring use of powerful magnifying equipment or as assessed using scattering methods), the present SOF is fundamentally different at the "macroscopic level" because the film is for instance orders of magnitude larger in coverage than a microscopic level COF network. SOFs described herein that may be used in the embodiments described herein are solvent resistant and have macroscopic morphologies much different than typical COFs previously synthesized. In the detailed description, the term "SOF" or "SOF composition" should be read once as modified by the term "fluorinated" (unless already expressly so modified), and then read again as not so modified unless otherwise indicated in context.

The term "fluorinated SOF" refers, for example, to a SOF that contains fluorine atoms covalently bonded to one or more segment types or linker types of the SOF. The fluorinated SOFs of the present disclosure may further comprise fluorinated molecules that are not covalently bound to the framework of the SOF, but are randomly distributed in the fluorinated SOF composition (i.e., a composite fluorinated SOF). However, an SOF, which does not contain fluorine atoms covalently bonded to one or more segment types or linker types of the SOF, that merely includes fluorinated molecules that are not covalently bonded to one or more segments or linkers of the SOF is a composite SOF, not a fluorinated SOF.

Designing and tuning the fluorine content in the SOF compositions of the present disclosure is straightforward and neither requires synthesis of custom polymers, nor requires blending/dispersion procedures. Furthermore, the SOF compositions of the present disclosure may be SOF compositions in which the fluorine content is uniformly dispersed and patterned at the molecular level. Fluorine content in the SOFs of the present disclosure may be adjusted by changing the molecular building block used for SOF synthesis or by changing the amount of fluorine building block employed.

In embodiments, the fluorinated SOF may be made by the reaction of one or more suitable molecular building blocks, where at least one of the molecular building block segments comprises fluorine atoms.

In embodiments, the imaging members and/or photoreceptors of the present disclosure comprise an outermost layer that comprises a fluorinated SOF in which a first segment having hole transport properties, which may or may not be obtained from the reaction of a fluorinated building block, may be linked to a second segment that is fluorinated, such as a second segment that has been obtained from the reaction of a fluorine-containing molecular building block.

In embodiments, the fluorine content of the fluorinated SOFs comprised in the imaging members and/or photoreceptors of the present disclosure may be homogeneously distributed throughout the SOF. The homogenous distribution of fluorine content in the SOF comprised in the imaging members and/or photoreceptors of the present disclosure may be controlled by the SOF forming process and therefore the fluorine content may also be patterned at the molecular level.

In embodiments, the outermost layer of the imaging members and/or photoreceptors comprises an SOF wherein the microscopic arrangement of segments is patterned. The term "patterning" refers, for example, to the sequence in which segments are linked together. A patterned fluorinated SOF would therefore embody a composition wherein, for example, segment A (having hole transport molecule functions) is only connected to segment B (which is a fluorinated segment), and conversely, segment B is only connected to segment A.

In embodiments, the outermost layer of the imaging members and/or photoreceptors comprises an SOF having only one segment, say segment A (for example having both hole transport molecule functions and being fluorinated), is employed and will be patterned because A is intended to only react with A.

In principle a patterned SOF may be achieved using any number of segment types. The patterning of segments may be controlled by using molecular building blocks whose functional group reactivity is intended to compliment a partner molecular building block and wherein the likelihood of a molecular building block to react with itself is minimized. The aforementioned strategy to segment patterning is non-limiting.

In embodiments, the outermost layer of the imaging members and/or photoreceptors comprises patterned fluorinated SOFs having different degrees of patterning. For example, the patterned fluorinated SOF may exhibit full patterning, which may be detected by the complete absence of spectroscopic signals from building block functional groups. In other embodiments, the patterned fluorinated SOFs having lowered degrees of patterning wherein domains of patterning exist within the SOF.

It is appreciated that a very low degree of patterning is associated with inefficient reaction between building blocks and the inability to form a film. Therefore, successful implementation of the process of the present disclosure requires appreciable patterning between building blocks within the SOF. The degree of necessary patterning to form a patterned fluorinated SOF suitable for the outer layer of imaging members and/or photoreceptors can depend on the chosen building blocks and desired linking groups. The minimum degree of patterning required to form a suitable patterned fluorinated SOF for the outer layer of imaging members and/or photoreceptors may be quantified as formation of about 40% or more of the intended linking groups or about 50% or more of the intended linking groups; the nominal degree of patterning embodied by the present disclosure is formation of about 80% or more of the intended linking group, such as formation of about 95% or more of the intended linking groups, or about 100% of the intended linking groups. Formation of linking groups may be detected spectroscopically.

In embodiments, the fluorine content of the fluorinated SOFs comprised in the outermost layer of the imaging members and/or photoreceptors of the present disclosure may be distributed throughout the SOF in a heterogeneous manner, including various patterns, wherein the concentration or density of the fluorine content is reduced in specific areas, such as to form a pattern of alternating bands of high and low concentrations of fluorine of a given width. Such pattering maybe accomplished by utilizing a mixture of molecular building blocks sharing the same general parent molecular building block structure but differing in the degree of fluorination (i.e., the number of hydrogen atoms replaced with fluorine) of the building block.

In embodiments, the SOFs comprised in the outermost layer of the imaging members and/or photoreceptors of the present disclosure may possess a heterogeneous distribution of the fluorine content, for example, by the application of fluorinated secondary components with highly fluorinated or perfluorinated molecular structures along with the fluorinated building block to the top of a formed wet layer, which may result in a higher portion of fluorine content and/or segments on a given side of the SOF and thereby forming a heterogeneous distribution fluorine within the thickness of the SOF, such that a linear or nonlinear concentration gradient may be obtained in the resulting SOF obtained after promotion of the change of the wet layer to a dry SOF. In such embodiments, a majority of the fluorine content and/or highly fluorinated or perfluorinated segments may end up in the upper half (which is opposite the substrate) of the dry SOF or a majority of the fluorine content and/or highly fluorinated or perfluorinated segments may end up in the lower half (which is adjacent to the substrate) of the dry SOF.

In embodiments, comprised in the outermost layer of the imaging members and/or photoreceptors of the present disclosure may comprise non-fluorinated molecular building blocks (which may or may not have hole transport molecule functions) that may be added to the top surface of a deposited wet layer, which upon promotion of a change in the wet film, results in an SOF having a heterogeneous distribution of the non-fluorinated segments in the dry SOF. In such embodiments, a majority of the non-fluorinated segments may end up in the upper half (which is opposite the substrate) of the dry SOF or a majority of the non-fluorinated segments may end up in the lower half (which is adjacent to the substrate) of the dry SOF.

In embodiments, the fluorine content in the SOF comprised in the outermost layer of the imaging members and/or photoreceptors of the present disclosure may be easily altered by changing the fluorinated building block or the degree of fluorination of a given molecular building block. For example, the fluorinated SOF compositions of the present disclosure may be hydrophobic, and may also be tailored to possess an enhanced charge transport property by the selection of particular segments and/or secondary components, which may or may not be fluorinated.

In embodiments, the fluorinated SOFs may be made by the reaction of one or more molecular building blocks, where at least one of the molecular building blocks contains fluorine and at least one at least one of the molecular building blocks has charge transport molecule functions (or upon reaction results in a segment with hole transport molecule functions. For example, the reaction of at least one, or two or more molecular building blocks of the same or different fluorine content and hole transport molecule functions may be undertaken to produce a fluorinated SOF. In specific embodiments, all of the molecular building blocks in the reaction mixture may contain fluorine which may be used as the outermost layer of the imaging members and/or photoreceptors of the present disclosure. In embodiments, a different halogen, such as chlorine, and may optionally be contained in the molecular building blocks.

The fluorinated molecular building blocks may be derived from one or more building blocks containing a carbon or silicon atomic core; building blocks containing alkoxy cores; building blocks containing a nitrogen or phosphorous atomic core; building blocks containing aryl cores; building blocks containing carbonate cores; building blocks containing carbocyclic-, carbobicyclic-, or carbotricyclic core; and building blocks containing an oligothiophene core. Such fluorinated molecular building blocks may be derived by replacing or exchanging one or more hydrogen atoms with a fluorine atom. In embodiments, one or more one or more of the above molecular building blocks may have all the carbon bound hydrogen atoms replaced by fluorine. In embodiments, one or more one or more of the above molecular building blocks may have one or more hydrogen atoms replaced by a different halogen, such as by chlorine. In addition to fluorine, the SOFs of the present disclosure may also include other halogens, such as chlorine.

In embodiments, one or more fluorinated molecular building blocks may be respectively present individually or totally in the fluorinated SOF comprised in the outermost layer of the imaging members and/or photoreceptors of the present disclosure at a percentage of about 5 to about 100% by weight, such as at least about 50% by weight, or at least about 75% by weight, in relation to 100 parts by weight of the SOF.

In embodiments, the fluorinated SOF may have greater than about 20% of the H atoms replaced by fluorine atoms, such as greater than about 50%, greater than about 75%, greater than about 80%, greater than about 90%, or greater than about 95% of the H atoms replaced by fluorine atoms, or about 100% of the H atoms replaced by fluorine atoms.

In embodiments, the fluorinated SOF may have greater than about 20%, greater than about 50%, greater than about 75%, greater than about 80%, greater than about 90%, greater than about 95%, or about 100% of the C-bound H atoms replaced by fluorine atoms.

In embodiments, a significant hydrogen content may also be present, e.g. as carbon-bound hydrogen, in the SOFs of the present disclosure. In embodiments, in relation to the sum of the C-bound hydrogen and C-bound fluorine atoms, the percentage of the hydrogen atoms may be tailored to any desired amount. For example the ratio of C-bound hydrogen to C-bound fluorine may be less than about 10, such as a ratio of C-bound hydrogen to C-bound fluorine of less than about 5, or a ratio of C-bound hydrogen to C-bound fluorine of less than about 1, or a ratio of C-bound hydrogen to C-bound fluorine of less than about 0.1, or a ratio of C-bound hydrogen to C-bound fluorine of less than about 0.01.

In embodiments, the fluorine content of the fluorinated SOF comprised in the outermost layer of the imaging members and/or photoreceptors of the present disclosure may be of from about 5% to about 75% by weight, such as about 25% to about 65% by weight, or about 45% to about 55% by weight. In embodiments, the fluorine content of the fluorinated SOF comprised in the outermost layer of the imaging members and/or photoreceptors of the present disclosure is not less than about 25% by weight, such as not less than about 35% by weight, or not less than about 40% by weight, and an upper limit of the fluorine content is about 65% by weight, or about 55% by weight.

In embodiments, the outermost layer of the imaging members and/or photoreceptors of the present disclosure may comprise an SOF where any desired amount of the segments in the SOF may be fluorinated. For example, the percent of fluorine containing segments may be greater than about 10% by weight, such as greater than about 30% by weight, or greater than 50% by weight; and an upper limit percent of fluorine containing segments may be 100%, such as less than about 90% by weight, or less than about 70% by weight.

In embodiments, the outermost layer of the imaging members and/or photoreceptors of the present disclosure may comprise a first fluorinated segment and a second electroactive segment in the SOF of the outermost layer in an amount greater than about 70% by weight of the SOF, such as from about 75 to about 99.5 percent by weight of the SOF, or about 80 to about 99.5 percent by weight of the SOF.

In embodiments, the fluorinated SOF comprised in the outermost layer of the imaging members and/or photoreceptors of the present disclosure may be a "solvent resistant" SOF, a patterned SOF, a capped SOF, a composite SOF, and/or a periodic SOF, which collectively are hereinafter referred to generally as an "SOF," unless specifically stated otherwise.

The term "solvent resistant" refers, for example, to the substantial absence of (1) any leaching out any atoms and/or molecules that were at one time covalently bonded to the SOF and/or SOF composition (such as a composite SOF), and/or (2) any phase separation of any molecules that were at one time part of the SOF and/or SOF composition (such as a composite SOF), that increases the susceptibility of the layer into which the SOF is incorporated to solvent/stress cracking or degradation. The term "substantial absence" refers for example, to less than about 0.5% of the atoms and/or molecules of the SOF being leached out after continuously exposing or immersing the SOF comprising imaging member (or SOF imaging member layer) to a solvent (such as, for example, either an aqueous fluid, or organic fluid) for a period of about 24 hours or longer (such as about 48 hours, or about 72 hours), such as less than about 0.1% of the atoms and/or molecules of the SOF being leached out after exposing or immersing the SOF comprising to a solvent for a period of about 24 hours or longer (such as about 48 hours, or about 72 hours), or less than about 0.01% of the atoms and/or molecules of the SOF being leached out after exposing or immersing the SOF to a solvent for a period of about 24 hours or longer (such as about 48 hours, or about 72 hours).

The term "organic fluid" refers, for example, to organic liquids or solvents, which may include, for example, alkenes, such as, for example, straight chain aliphatic hydrocarbons, branched chain aliphatic hydrocarbons, and the like, such as where the straight or branched chain aliphatic hydrocarbons have from about 1 to about 30 carbon atoms, such as from about 4 to about 20 carbons; aromatics, such as, for example, toluene, xylenes (such as o-, m-, p-xylene), and the like and/or mixtures thereof; isopar solvents or isoparaffinic hydrocarbons, such as a non-polar liquid of the ISOPAR™ series, such as ISOPAR E, ISOPAR G, ISOPAR H, ISOPAR L and ISOPAR M (manufactured by the Exxon Corporation, these hydrocarbon liquids are considered narrow portions of isoparaffinic hydrocarbon fractions), the NORPAR™ series of liquids, which are compositions of n-paraffins available from Exxon Corporation, the SOLTROL™ series of liquids available from the Phillips Petroleum Company, and the SHELLSOL™ series of liquids available from the Shell Oil Company, or isoparaffinic hydrocarbon solvents having from about 10 to about 18 carbon atoms, and or mixtures thereof. In embodiments, the organic fluid may be a mixture of one or more solvents, i.e., a solvent system, if desired. In addition, more polar solvents may also be used, if desired. Examples of more polar solvents that may be used include halogenated and nonhalogenated solvents, such as tetrahydrofuran, trichloro- and tetrachloroethane, dichloromethane, chloroform, monochlorobenzene, acetone, methanol, ethanol, benzene, ethyl acetate, dimethylformamide, cyclohexanone, N-methyl acetamide and the like. The solvent may be composed of one, two, three or more different solvents and/or and other various mixtures of the above-mentioned solvents.

When a capping unit is introduced into the SOF, the SOF framework is locally 'interrupted' where the capping units are present. These SOF compositions are 'covalently doped' because a foreign molecule is bonded to the SOF framework when capping units are present. Capped SOF compositions may alter the properties of SOFs without changing constituent building blocks. For example, the mechanical and physical properties of the capped SOF where the SOF framework is interrupted may differ from that of an uncapped SOF. In embodiments, the capping unit may be fluorinated which would result in a fluorinated SOF, such as a capping group obtained from a fluorinated alcohol having from about 2 to about 100 carbon atoms, such as from about 5 to about 60 carbon atoms, or at least one compound of the general formula $CF_3(CF_2)_x(OH)$ where x is an integer in the range of from about 2 to about 100, such as from about 5 to about 60, or from about 10 to about 30.

The SOFs of the present disclosure may be, at the macroscopic level, substantially pinhole-free SOFs or pinhole-free SOFs having continuous covalent organic frameworks that can extend over larger length scales such as for instance much greater than a millimeter to lengths such as a meter and, in theory, as much as hundreds of meters. It will also be appreciated that SOFs tend to have large aspect ratios where typically two dimensions of a SOF will be much larger than the third. SOFs have markedly fewer macroscopic edges and disconnected external surfaces than a collection of COF particles.

In embodiments, a "substantially pinhole-free SOF" or "pinhole-free SOF" may be formed from a reaction mixture deposited on the surface of an underlying substrate. The term "substantially pinhole-free SOF" refers, for example, to an SOF that may or may not be removed from the underlying substrate on which it was formed and contains substantially no pinholes, pores or gaps greater than the distance between the cores of two adjacent segments per square cm; such as, for example, less than 10 pinholes, pores or gaps greater than about 250 nanometers in diameter per $cm^2$, or less than 5 pinholes, pores or gaps greater than about 100 nanometers in diameter per $cm^2$. The term "pinhole-free SOF" refers, for example, to an SOF that may or may not be removed from the underlying substrate on which it was formed and contains no pinholes, pores or gaps greater than the distance between the cores of two adjacent segments per $micron^2$, such as no pinholes, pores or gaps greater than about 500 Angstroms in diameter per $micron^2$, or no pinholes, pores or gaps greater than about 250 Angstroms in diameter per $micron^2$, or no pinholes, pores or gaps greater than about 100 Angstroms in diameter per $micron^2$.

A description of various exemplary molecular building blocks, linkers, SOF types, capping groups, strategies to synthesize a specific SOF type with exemplary chemical structures, building blocks whose symmetrical elements are outlined, and classes of exemplary molecular entities and examples of members of each class that may serve as molecular building blocks, including fluorinated molecular building blocks for SOFs (which may be obtained from the fluorination of any of the non-fluorinated molecular building blocks by known processes) are detailed in U.S. patent application Ser. Nos. 12/716,524; 12/716,449; 12/716,706; 12/716,324; 12/716,686; 12/716,571; 12/815,688; 12/845,053; 12/845,235; 12/854,962; 12/854,957; 12/845,052, 13/042,950, 13/173,948, 13/181,761, 13/181,912, 13/174,046, 13/182,047, 13/246,109, 13/246,227, and 13/246,268, previously incorporated by reference).

For example, non-fluorinated molecular building blocks may be fluorinated via elemental fluorine at elevated temperatures, such as greater than about 150° C., or by other known process steps to form a mixture of fluorinated molecular building blocks having varying degrees of fluorination, which may be optionally purified to obtain an individual fluorinated molecular building block. Alternatively, fluorinated molecular building blocks may be synthesized and/or obtained by simple purchase of the desired fluorinated molecular building block. The conversion of a "parent" non-fluorinated molecular building block into a fluorinated molecular building block may take place under reaction conditions that utilize a single set or range of known reaction conditions, and may be a known one step reaction or known multi-step reaction. Exemplary reactions may include one or more known reaction mechanisms, such as an addition and/or an exchange.

For example, the conversion of a parent non-fluorinated molecular building block into a fluorinated molecular building block may comprise contacting a non-fluorinated molecular building block with a known dehydrohalogenation agent to produce a fluorinated molecular building block. In embodiments, the dehydrohalogenation step may be carried out under conditions effective to provide a conversion to replace at least about 50% of the H atoms, such as carbon-bound hydrogens, by fluorine atoms, such as greater than about 60%, greater than about 75%, greater than about 80%, greater than about 90%, or greater than about 95% of the H atoms, such as carbon-bound hydrogens, replaced by fluorine atoms, or about 100% of the H atoms replaced by fluorine atoms, in non-fluorinated molecular building block with fluorine. In embodiments, the dehydrohalogenation step may be carried out under conditions effective to provide a conversion that replaces at least about 99% of the hydrogens, such as carbon-bound hydrogens, in non-fluorinated molecular building block with fluorine. Such a reaction may be carried out in the liquid phase or in the gas phase, or in a combination of gas and liquid phases, and it is contemplated that the reaction can be carried out batch wise, continuous, or a combination of these. Such a reaction may be carried out in the presence of catalyst, such as activated carbon. Other catalysts may be used, either alone or in conjunction with one another or depending on the requirements of particular molecular building block being fluorinated, including for example palladium-based catalyst, platinum-based catalysts, rhodium-based catalysts and ruthenium-based catalysts.

Molecular Building Block

The SOFs of the present disclosure comprise molecular building blocks having a segment (S) and functional groups (Fg). Molecular building blocks require at least two functional groups ($x \geq 2$) and may comprise a single type or two or more types of functional groups. Functional groups are the reactive chemical moieties of molecular building blocks that participate in a chemical reaction to link together segments during the SOF forming process. A segment is the portion of the molecular building block that supports functional groups and comprises all atoms that are not associated with functional groups. Further, the composition of a molecular building block segment remains unchanged after SOF formation.

Use of symmetrical building blocks is practiced in embodiments of the present disclosure for two reasons: (1) the patterning of molecular building blocks may be better anticipated because the linking of regular shapes is a better understood process in reticular chemistry, and (2) the complete reaction between molecular building blocks is facilitated because for less symmetric building blocks errant conformations/orientations may be adopted which can possibly initiate numerous linking defects within SOFs.

Figure 1O:
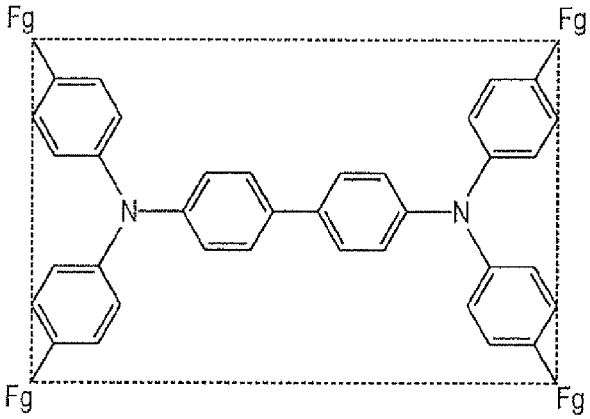

FIGS. 1A-O illustrate exemplary building blocks whose symmetrical elements are outlined. Such symmetrical elements are found in building blocks that may be used in the present disclosure. Such exemplary building blocks may or may not be fluorinated. In embodiments, the SOF comprises at least one symmetrical building block, which may or may not be fluorinated, selected from the group consisting of ideal triangular building blocks, distorted triangular building blocks, ideal tetrahedral building blocks, distorted tetrahedral building blocks, ideal square building blocks, and distorted square building blocks.

Functional Group

Functional groups are the reactive chemical moieties of molecular building blocks that participate in a chemical reaction to link together segments during the SOF forming process. Functional groups may be composed of a single atom, or functional groups may be composed of more than one atom. The atomic compositions of functional groups are those compositions normally associated with reactive moieties in chemical compounds. Non-limiting examples of functional groups include halogens, alcohols, ethers, ketones, carboxylic acids, esters, carbonates, amines, amides, imines, ureas, aldehydes, isocyanates, tosylates, alkenes, alkynes and the like.

Molecular building blocks contain a plurality of chemical moieties, but only a subset of these chemical moieties are intended to be functional groups during the SOF forming process. Whether or not a chemical moiety is considered a functional group depends on the reaction conditions selected for the SOF forming process. Functional groups (Fg) denote a chemical moiety that is a reactive moiety, that is, a functional group during the SOF forming process.

In the SOF forming process, the composition of a functional group will be altered through the loss of atoms, the gain of atoms, or both the loss and the gain of atoms; or, the functional group may be lost altogether. In the SOF, atoms previously associated with functional groups become associated with linker groups, which are the chemical moieties that join together segments. Functional groups have characteristic chemistries and those of ordinary skill in the art can generally recognize in the present molecular building blocks the atom(s) that constitute functional group(s). It should be noted that an atom or grouping of atoms that are identified as part of the molecular building block functional group may be preserved in the linker group of the SOF. Linker groups are described below.

Segment

A segment is the portion of the molecular building block that supports functional groups and comprises all atoms that are not associated with functional groups. Further, the composition of a molecular building block segment remains unchanged after SOF formation. In embodiments, the SOF may contain a first segment having a structure the same as or different from a second segment. In other embodiments, the structures of the first and/or second segments may be the same as or different from a third segment, forth segment, fifth segment, etc. A segment is also the portion of the molecular building block that can provide an inclined property. Inclined properties are described later in the embodiments.

The SOF of the present disclosure comprise a plurality of segments including at least a first fluorinated segment type and a plurality of linkers including at least a first linker type arranged as a covalent organic framework (COF) having a plurality of pores, wherein the first segment type and/or the first linker type comprises at least one atom that is not carbon (e.g., fluorine). In embodiments, the segment (or one or more of the segment types included in the plurality of segments making up the SOF) of the SOF comprises at least one atom of an element that is not carbon, such as where the structure of the segment comprises at least one atom selected from the group consisting of hydrogen, oxygen, nitrogen, silicon, phosphorous, selenium, fluorine, boron, and sulfur.

Linker

A linker is a chemical moiety that emerges in a SOF upon chemical reaction between functional groups present on the molecular building blocks and/or capping unit.

A linker may comprise a covalent bond, a single atom, or a group of covalently bonded atoms. The former is defined as a covalent bond linker and may be, for example, a single covalent bond or a double covalent bond and emerges when functional groups on all partnered building blocks are lost entirely. The latter linker type is defined as a chemical moiety linker and may comprise one or more atoms bonded together by single covalent bonds, double covalent bonds, or combinations of the two. Atoms contained in linking groups originate from atoms present in functional groups on molecular building blocks prior to the SOF forming process. Chemical moiety linkers may be well-known chemical groups such as, for example, esters, ketones, amides, imines, ethers, urethanes, carbonates, and the like, or derivatives thereof.

For example, when two hydroxyl (—OH) functional groups are used to connect segments in a SOF via an oxygen atom, the linker would be the oxygen atom, which may also be described as an ether linker. In embodiments, the SOF may contain a first linker having a structure the same as or different from a second linker. In other embodiments, the structures of the first and/or second linkers may be the same as or different from a third linker, etc.

The SOF of the present disclosure comprise a plurality of segments including at least a first segment type and a plurality of linkers including at least a first linker type arranged as a covalent organic framework (COF) having a plurality of pores, wherein the first segment type and/or the first linker type comprises at least one atom that is not carbon. In embodiments, the linker (or one or more of the plurality of linkers) of the SOF comprises at least one atom of an element that is not carbon, such as where the structure of the linker comprises at least one atom selected from the group consisting of hydrogen, oxygen, nitrogen, silicon, phosphorous, selenium, fluorine, boron, and sulfur.

Added Functionality of SOFs

Added functionality denotes a property that is not inherent to conventional COFs and may occur by the selection of molecular building blocks wherein the molecular compositions provide the added functionality in the resultant SOF. Added functionality may arise upon assembly of molecular building blocks having an "inclined property" for that added functionality. Added functionality may also arise upon assembly of molecular building blocks having no "inclined property" for that added functionality but the resulting SOF has the added functionality as a consequence of linking segments (S) and linkers into a SOF. Furthermore, emergence of added functionality may arise from the combined effect of using molecular building blocks bearing an "inclined property" for that added functionality whose inclined property is modified or enhanced upon linking together the segments and linkers into a SOF.

An Inclined Property of a Molecular Building Block

The term "inclined property" of a molecular building block refers, for example, to a property known to exist for certain molecular compositions or a property that is reasonably identifiable by a person skilled in art upon inspection of the molecular composition of a segment. As used herein, the terms "inclined property" and "added functionality" refer to the same general property (e.g., hydrophobic, electroactive, etc.) but "inclined property" is used in the context of the molecular building block and "added functionality" is used in the context of the SOF, which may be comprised in the outermost layer of the imaging members and/or photoreceptors of the present disclosure.

Fluorine-containing polymers are known to have lower surface energies than the corresponding hydrocarbon polymers. For example, polytetrafluoroethylene (PTFE) has a lower surface energy than polyethylene (20 mN/m vs 35.3 mN/m). The introduction of fluorine into SOFs, particularly when fluorine is present at the surface the outermost layer of the imaging members and/or photoreceptors of the present disclosure, may be used to modulate the surface energy of the SOF compared to the corresponding, non-fluorinated SOF. In most cases, introduction of fluorine into the SOF will lower the surface energy of the outermost layer of the imaging members and/or photoreceptors of the present disclosure. The extent the surface energy of the SOF is modulated, may, for example, depend on the degree of fluorination and/or the patterning of fluorine at the surface of the SOF and/or within the bulk of the SOF. The degree of fluorination and/or the patterning of fluorine at the surface of the SOF are parameters that may be tuned by the processes of the present disclosure.

Molecular building blocks comprising or bearing highly-fluorinated segments have inclined hydrophobic properties and may lead to SOFs with hydrophobic added functionality. Highly-fluorinated segments are defined as the number of fluorine atoms present on the segment(s) divided by the number of hydrogen atoms present on the segment(s) being greater than one. Fluorinated segments, which are not highly-fluorinated segments may also lead to SOFs with hydrophobic added functionality.

As discussed above, the fluorinated SOFs comprised in the outermost layer of the imaging members and/or photoreceptors of the present disclosure may be made from versions of any of the molecular building blocks, segments, and/or linkers wherein one or more hydrogen(s) in the molecular building blocks are replaced with fluorine.

The above-mentioned fluorinated segments may include, for example, α,ω-fluoroalkyldiols of the general structure:

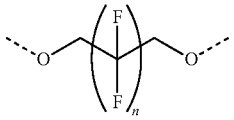

where n is an integer having a value of 1 or more, such as of from 1 to about 100, or 1 to about 60, or about 2 to about 30, or about 4 to about 10; or fluorinated alcohols of the general structure $HOCH_2(CF_2)_nCH_2OH$ and their corresponding dicarboxylic acids and aldehydes, where n is an integer having a value of 1 or more, such as of from 1 to about 100, or 1 to about 60, or about 2 to about 30, or about 4 to about 10; tetrafluorohydroquinone; perfluoroadipic acid hydrate, 4,4'-(hexafluoroisopropylidene)diphthalic anhydride; 4,4'-(hexafluoroisopropylidene)diphenol, and the like.

SOFs having a rough, textured, or porous surface on the sub-micron to micron scale may also be hydrophobic. The rough, textured, or porous SOF surface can result from dangling functional groups present on the film surface or from the structure of the SOF. The type of pattern and degree of patterning depends on the geometry of the molecular building blocks and the linking chemistry efficiency. The feature size that leads to surface roughness or texture is from about 100 nm to about 10 μm, such as from about 500 nm to about 5 μm.

The term electroactive refers, for example, to the property to transport electrical charge (electrons and/or holes). Electroactive materials include conductors, semiconductors, and charge transport materials. Conductors are defined as materials that readily transport electrical charge in the presence of a potential difference. Semiconductors are defined as materials do not inherently conduct charge but may become conductive in the presence of a potential difference and an applied stimuli, such as, for example, an electric field, electromagnetic radiation, heat, and the like. Charge transport materials are defined as materials that can transport charge when charge is injected from another material such as, for example, a dye, pigment, or metal in the presence of a potential difference.

Fluorinated SOFs with electroactive added functionality (or hole transport molecule functions) comprised in outermost layer of the imaging members and/or photoreceptors of the present disclosure may be prepared by forming a reaction mixture containing the fluorinated molecular building blocks discussed and molecular building blocks with inclined electroactive properties and/or molecular building blocks that become electroactive as a result of the assembly of conjugated segments and linkers. The following sections describe molecular building blocks with inclined hole transport properties, inclined electron transport properties, and inclined semiconductor properties.

Conductors may be further defined as materials that give a signal using a potentiometer from about 0.1 to about $10^7$ S/cm.

Semiconductors may be further defined as materials that give a signal using a potentiometer from about $10^{-6}$ to about $10^4$ S/cm in the presence of applied stimuli such as, for example an electric field, electromagnetic radiation, heat, and the like. Alternatively, semiconductors may be defined as materials having electron and/or hole mobility measured using time-of-flight techniques in the range of $10^{-10}$ to about $10^6$ $cm^2V^{-1}s^{-1}$ when exposed to applied stimuli such as, for example an electric field, electromagnetic radiation, heat, and the like.

Charge transport materials may be further defined as materials that have electron and/or hole mobility measured using time-of-flight techniques in the range of $10^{-10}$ to about $10^6$ $cm^2V^{-1}s^{-1}$. It should be noted that under some circumstances charge transport materials may be also classified as semiconductors.

In embodiments, fluorinated SOFs with electroactive added functionality may be prepared by reacting fluorinated molecular building blocks with molecular building blocks with inclined electroactive properties and/or molecular building blocks that result in electroactive segments resulting from the assembly of conjugated segments and linkers. In embodiments, the fluorinated SOF comprised in the outermost layer of the imaging members and/or photoreceptors of the present disclosure may be made by preparing a reaction mixture containing at least one fluorinated building block and at least one building block having electroactive properties, such as hole transport molecule functions, such HTM segments may those described below such as N,N,N',N'-tetrakis-[(4-hydroxymethyl)phenyl]-biphenyl-4,4'-diamine, having a hydroxyl functional group (—OH) and upon reaction results in a segment of N,N,N',N'-tetra-(p-tolyl)biphenyl-4,4'-diamine; and/or N,N'-diphenyl-N,N'-bis-(3-hydroxyphenyl)-biphenyl-4,4'-diamine, having a hydroxyl functional group (—OH) and upon reaction results in a segment of N,N,N',N'-tetraphenyl-biphenyl-4,4'-diamine. Further molecular building blocks and/or the resulting segment core with inclined hole transport properties, inclined electron transport properties, and inclined semiconductor properties, that may be reacted with fluorinated building blocks (described above) to produce the fluorinated SOF comprised in the outermost layer of the imaging members and/or photoreceptors of the present disclosure.

SOFs with hole transport added functionality may be obtained by selecting segment cores such as, for example, triarylamines, hydrazones (U.S. Pat. No. 7,202,002 B2 to Tokarski et al.), and enamines (U.S. Pat. No. 7,416,824 B2 to Kondoh et al.) with the following general structures:

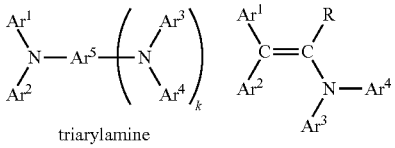

triarylamine enamines

-continued

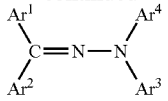

hydrazones

For example, the segment core comprising a triarylamine being represented by the following general formula:

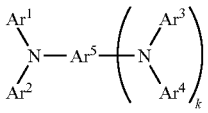

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least two of $Ar^1$, $Ar^2$, $Ar^3$, $Ar^4$ and $Ar^5$ comprises a Fg (previously defined). $Ar^5$ may be further defined as, for example, a substituted phenyl ring, substituted/unsubstituted phenylene, substituted/unsubstituted monovalently linked aromatic rings such as biphenyl, terphenyl, and the like, or substituted/unsubstituted fused aromatic rings such as naphthyl, anthranyl, phenanthryl, and the like.

Segment cores comprising arylamines with hole transport added functionality include, for example, aryl amines such as triphenylamine, N,N,N',N'-tetraphenyl-(1,1'-biphenyl)-4,4'-diamine, N,N'-diphenyl-N,N'-bis(3-methylphenyl)-(1,1'-biphenyl)-4,4'-diamine, N,N'-bis(4-butylphenyl)-N,N'-diphenyl-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like.

The SOF may be a p-type semiconductor, n-type semiconductor or ambipolar semiconductor. The SOF semiconductor type depends on the nature of the molecular building blocks. Molecular building blocks that possess an electron donating property such as alkyl, alkoxy, aryl, and amino groups, when present in the SOF, may render the SOF a p-type semiconductor. Alternatively, molecular building blocks that are electron withdrawing such as cyano, nitro, fluoro, fluorinated alkyl, and fluorinated aryl groups may render the SOF into the n-type semiconductor.

Similarly, the electroactivity of SOFs prepared by these molecular building blocks will depend on the nature of the segments, nature of the linkers, and how the segments are orientated within the SOF. Linkers that favor preferred orientations of the segment moieties in the SOF are expected to lead to higher electroactivity.

Process for Preparing a Fluorinated Structured Organic Film (SOF)

The process for making SOFs of the present disclosure, such as fluorinated SOFs, typically comprises a number of activities or steps (set forth below) that may be performed in any suitable sequence or where two or more activities are performed simultaneously or in close proximity in time. For example, a process for preparing a fluorinated SOF containing fluorinated secondary components may comprise:

(a) preparing a liquid-containing reaction mixture comprising a plurality of molecular building blocks, each comprising a segment (where at least one segment may comprise fluorine and at least one of the resulting segments is electroactive, such as an HTM) and a number of functional groups, and optionally a pre-SOF, and dispersing fluorinated secondary components with a dispersants to obtain a suspension (or dispersion) in solvent and mixing the suspension (or dispersion) with the reaction mixture comprising a plurality of molecular building blocks;

(b) depositing the reaction mixture as a wet film;

(c) promoting a change of the wet film including the molecular building blocks to a dry film comprising the SOF comprising a plurality of the segments and a plurality of linkers arranged as a covalent organic framework, wherein at a macroscopic level the covalent organic framework is a film;

(d) optionally removing the SOF from the substrate to obtain a free-standing SOF;

(e) optionally processing the free-standing SOF into a roll;

(f) optionally cutting and seaming the SOF into a belt; and (g) optionally performing the above SOF formation process(es) upon an SOF (which was prepared by the above SOF formation process(es)) as a substrate for subsequent SOF formation process(es).

The process for making capped fluorinated SOFs containing fluorinated secondary components and/or fluorinated SOFs containing fluorinated secondary components typically comprises a similar number of activities or steps (set forth above). The fluorinated secondary components may be added during either step (a), (b) or (c), depending on the desired distribution of the fluorinated secondary components in the resulting SOF. For example, if it is desired that the fluorinated secondary components distribution is substantially uniform over the resulting SOF, the fluorinated secondary components may be added during step (a). Alternatively, if, for example, a more heterogeneous distribution of the fluorinated secondary components is desired, adding the fluorinated secondary components (such as by spraying it on the film formed during step b or during the promotion step of step c) may occur during steps b and c.

The above activities or steps may be conducted at atmospheric, super atmospheric, or subatmospheric pressure. The term "atmospheric pressure" as used herein refers to a pressure of about 760 torr. The term "super atmospheric" refers to pressures greater than atmospheric pressure, but less than 20 atm. The term "subatmospheric pressure" refers to pressures less than atmospheric pressure. In an embodiment, the activities or steps may be conducted at or near atmospheric pressure. Generally, pressures of from about 0.1 atm to about 2 atm, such as from about 0.5 atm to about 1.5 atm, or 0.8 atm to about 1.2 atm may be conveniently employed.

Process Action A: Preparation of the Liquid-Containing Reaction Mixture

The reaction mixture comprises a plurality of molecular building blocks that are dissolved, suspended, or mixed in a liquid, such building blocks may include, for example, at least one fluorinated building block, and at least one electroactive building block, such as, for example, N,N,N',N'-tetrakis-[(4-hydroxymethyl)phenyl]-biphenyl-4,4'-diamine, having a hydroxyl functional group (—OH) and a segment of N,N,N',N'-tetra-(p-tolyl)biphenyl-4,4'-diamine, and/or N,N'-diphenyl-N,N'-bis-(3-hydroxyphenyl)-biphenyl-4,4'-diamine, having a hydroxyl functional group (—OH) and a segment of N,N,N',N'-tetraphenyl-biphenyl-4,4'-diamine. The plurality of molecular building blocks may be of one type or two or more types. When one or more of the molecular building blocks is a liquid, the use of an additional liquid is optional. Catalysts may optionally be added to the reaction mixture to enable SOF formation or modify the kinetics of SOF formation during Action C described above.

A fluorinated secondary components (fluoro-polymer) suspension or dispersion may be prepared including fluoro-polymer, and optionally, a dispersant in a solvent. In embodiments, the fluoro-polymer may be present in an amount ranging from about 1% to about 90%, or ranging from about 3% to about 80%, or ranging from about 5% to about 60% by weight of the total fluoro-polymer dispersion, which is subsequently mixed with the above reaction mixture by the methods described below.

In embodiments, the dispersant may be a perfluoro-surfactant having the following general formula:

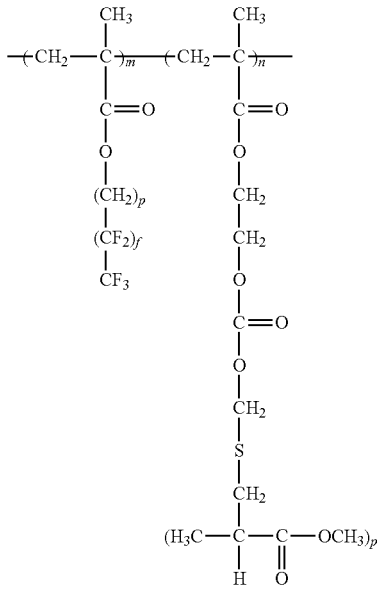

where m and n independently represent integers of from about 1 to about 300, p represents an integer of from about 1 to about 100, f represents an integer of from about 1 to about 20, and i represents an integer of from about 1 to about 500. In embodiments, other suitable perfluoro-surfactants can also be used.

In embodiments, the dispersant may be a hydroxyl-containing fluorinated dispersant comprises a polyacrylate polymer containing a hydroxyl and a fluoroalkyl group having from about 6 to about 20 carbons.

The solvent for the dispersion may be, for example, water, hydrocarbon solvent, alcohol, ketone, chlorinated solvent, ester, ether, and the like. Suitable hydrocarbon solvents can include an aliphatic hydrocarbon having at least 5 carbon atoms to about 20 carbon atoms, such as pentane, hexane, heptane, octane, nonane, decane, undecane, dodecane, tridecane, tetradecane, pentadecane, hexadecane, heptadecane, dodecene, tetradecene, hexadecane, heptadecene, octadecene, terpinenes, isoparaffinic solvents, and their isomers; an aromatic hydrocarbon having from about 7 carbon atoms to about 18 carbon atoms, such as toluene, xylene, ethyltoluene, mesitylene, trimethylbenzene, diethyl benzene, tetrahydronaphthalene, ethylbenzene, and their isomers and mixtures. Suitable alcohol can have at least 6 carbon atoms and can be, for example, hexanol, heptanol, octanol, nonanol, decanol, undecanol, dodecanol, tetradecanol, and hexadecanol; a diol such as hexanediol, heptanediol, octanediol, nonanediol, and decanediol; an alcohol including an unsaturated double bond, such as famesol, dedecadienol, linalool, geraniol, nerol, heptadienol, tetradecenol, hexadeceneol, phytol, oleyl alchohol, dedecenol, decenol, undecylenyl alcohol, nonenol, citronellol, octenol, and heptenol; a cycloaliphatic alcohol with or without an unsaturated double bond, such as methylcyclohexanol, menthol, dimethylcyclohexanol, methylcyclohexenol, terpineol, dihydrocarveol, isopulegol, cresol, trimethyicyclohexenol; and the like.

In embodiments, the fluorinated secondary components may be particles that have a diameter size of from about 10 nanometers to about 10 microns, such as fluorinated secondary components having a size in the range of from 100 nm to 5000 nm, such as particles that have a diameter size of from 100 nm to 5000 nm. In specific embodiments, the fluorinated secondary component may be particles that comprise a fluoro-polymer core with a diameter size ranging from about 20 nanometers to about 800 nanometers and a polymeric shell with a thickness of from about 90 nanometers to about 0.5 microns, or from about 100 nanometers to about 300 nanometers.

In embodiments, the SOF overcoat layer (such as an overcoat layer for photoreceptors with BCR charging systems) may comprise an effective amount of fluorinated secondary components such as PTFE in order to improve wear rates and reduce torque. For example, the torque, which may be assessed by employing a torque transducer sensor, may be less than 1 Nm, such as from about 0.05 Nm to about 0.9 Nm, or from about 0.4 Nm to 0.8 Nm. In such embodiments, the SOF overcoat layers may be prepared with an effective fluorinated particles loading. For example, an effective loading of fluorinated secondary components would demonstrate a similar photoinduced discharge curve (PIDC) characteristic as an overcoat layer without the fluorinated secondary components loadings, but additionally demonstrate lower torque (e.g., lower friction with the cleaning blade) and/or wear rate than the control overcoat layer. In embodiments, fluorinated particles loadings in the SOF overcoat may range from about 1 to 40%, such as from about 5 to about 35%, or from about 10 to about 25% by weight of the overcoat layer or the SOF of the overcoat layer. Other additives or secondary components may optionally be added to the reaction mixture to alter the physical properties of the resulting SOF.

The reaction mixture components (molecular building blocks, fluorinated particle dispersion, optionally a capping unit, liquid (solvent), optionally catalysts, and optionally other additives) are combined (such as in a vessel). The order of addition of the reaction mixture components may vary; however, typically the catalyst is added last. In particular embodiments, the molecular building blocks are heated in the liquid in the absence of the catalyst to aid the dissolution of the molecular building blocks. The reaction mixture may also be mixed, stirred, milled, sonicated, or the like, to ensure even distribution of the formulation components prior to depositing the reaction mixture as a wet film.

In embodiments, the reaction mixture may be heated prior to being deposited as a wet film. This may aid the dissolution of one or more of the molecular building blocks and/or increase the viscosity of the reaction mixture by the partial reaction of the reaction mixture prior to depositing the wet layer. This approach may be used to increase the loading of the molecular building blocks in the reaction mixture.

In particular embodiments, the reaction mixture needs to have a viscosity that will support the deposited wet layer. Reaction mixture viscosities range from about 10 to about 50,000 cps, such as from about 25 to about 25,000 cps or from about 50 to about 1000 cps.

The molecular building block and capping unit loading or "loading" in the reaction mixture is defined as the total weight of the molecular building blocks and optionally the capping units and catalysts divided by the total weight of the reaction mixture. Building block loadings may range from about 10 to 50%, such as from about 20 to about 40%, or from about 25 to about 30%.

In embodiments, the wear rate of the dry SOF of the imaging member or a particular layer of the imaging member may be adjusted or modulated by selecting a predetermined building block or combination of building block loading of the SOF liquid formulation along with the fluorinated particle dispersion loading. In embodiments, the wear rate of the imaging member may be from about 0.5 to about 30 nanometers per kilocycle rotation or from about 7 to about 25 nanometers per kilocycle rotation in an experimental fixture.

The wear rate of the dry SOF of the imaging member or a particular layer of the imaging member may also be adjusted or modulated by inclusion of a capping unit and/or further secondary components with the predetermined building block or combination of building block loading of the SOF liquid formulation. In embodiments, an effective secondary component and/or capping unit and/or effective capping unit and/or secondary component concentration in the dry SOF may be selected to either decrease the wear rate of the imaging member or increase the wear rate of the imaging member. In embodiments, the wear rate of the imaging member may be decreased by at least about 2% per 1000 cycles, such as by at least about 5% per 100 cycles, or at least 10% per 1000 cycles relative to a non-capped SOF comprising the same segment(s) and linker(s).

Liquids used to prepare the reaction mixture (i.e., dissolve or suspend the molecular building blocks) may be pure liquids, such as solvents, and/or solvent mixtures. Liquids are used to dissolve or suspend the molecular building blocks and catalyst/modifiers in the reaction mixture. Liquid selection is generally based on balancing the solubility/dispersion of the molecular building blocks and a particular building block loading, the viscosity of the reaction mixture, and the boiling point of the liquid, which impacts the promotion of the wet layer to the dry SOF. Suitable liquids may have boiling points from about 30 to about 300° C., such as from about 65° C. to about 250° C., or from about 100° C. to about 180° C.

Liquids can include molecule classes such as alkanes (hexane, heptane, octane, nonane, decane, cyclohexane, cycloheptane, cyclooctane, decalin); mixed alkanes (hexanes, heptanes); branched alkanes (isooctane); aromatic compounds (toluene, o-, m-, p-xylene, mesitylene, nitrobenzene, benzonitrile, butylbenzene, aniline); ethers (benzyl ethyl ether, butyl ether, isoamyl ether, propyl ether); cyclic ethers (tetrahydrofuran, dioxane), esters (ethyl acetate, butyl acetate, butyl butyrate, ethoxyethyl acetate, ethyl propionate, phenyl acetate, methyl benzoate); ketones (acetone, methyl ethyl ketone, methyl isobutylketone, diethyl ketone, chloroacetone, 2-heptanone), cyclic ketones (cyclopentanone, cyclohexanone), amines (1°, 2°, or 3° amines such as butylamine, diisopropylamine, triethylamine, diisoproylethylamine; pyridine); amides (dimethylformamide, N-methylpyrolidinone, N,N-dimethylformamide); alcohols (methanol, ethanol, n-, i-propanol, n-, i-, t-butanol, 1-methoxy-2-propanol, hexanol, cyclohexanol, 3-pentanol, benzyl alcohol); nitriles (acetonitrile, benzonitrile, butyronitrile), halogenated aromatics (chlorobenzene, dichlorobenzene, hexafluorobenzene), halogenated alkanes (dichloromethane, chloroform, dichloroethylene, tetrachloroethane); and water.

The term "substantially removing" refers to, for example, the removal of at least 90% of the respective solvent, such as about 95% of the respective solvent. The term "substantially leaving" refers to, for example, the removal of no more than 2% of the respective solvent, such as removal of no more than 1% of the respective solvent.

Optionally a catalyst may be present in the reaction mixture to assist the promotion of the wet layer to the dry SOF. Selection and use of the optional catalyst depends on the functional groups on the molecular building blocks. Catalysts may be homogeneous (dissolved) or heterogeneous (undissolved or partially dissolved) and include Brönsted acids (HCl (aq), acetic acid, p-toluenesulfonic acid, amine-protected p-toluenesulfonic acid such as pyrridium p-toluenesulfonate, trifluoroacetic acid); Lewis acids (boron trifluoroetherate, aluminum trichloride); Brönsted bases (metal hydroxides such as sodium hydroxide, lithium hydroxide, potassium hydroxide; 1°, 2°, or 3° amines such as butylamine, diisopropylamine, triethylamine, diisoproylethylamine); Lewis bases (N,N-dimethyl-4-aminopyridine); metals (Cu bronze); metal salts ($FeCl_3$, $AuCl_3$); and metal complexes (ligated palladium complexes, ligated ruthenium catalysts). Typical catalyst loading ranges from about 0.01% to about 25%, such as from about 0.1% to about 5% of the molecular building block loading in the reaction mixture. The catalyst may or may not be present in the final SOF composition.

Optionally additives or secondary components (in addition to the fluorinated secondary components), such as dopants, may be present in the reaction mixture and wet layer. Such additives or secondary components may also be integrated into a dry SOF. Additives or secondary components can be homogeneous or heterogeneous in the reaction mixture and wet layer or in a dry SOF. In contrast to capping units, the terms "additive" or "secondary component," refer, for example, to atoms or molecules that are not covalently bound in the SOF, but are randomly distributed in the composition. Suitable secondary components and additives are described in U.S. patent application Ser. No. 12/716,324, entitled "Composite Structured Organic Films," the disclosure of which is totally incorporated herein by reference in its entirety.

In embodiments, the SOF may contain antioxidants as a secondary component to protect the SOF from oxidation. In embodiments, the antioxidants that are selected so as to match the oxidation potential of the hole transport material. For example, the antioxidants may be chosen, for example, from among sterically hindered bis-phenols, sterically hindered dihydroquinones, or sterically hindered amines. The antioxidants may be chosen, for example, from among sterically hindered bis-phenols, sterically hindered dihydroquinones, or sterically hindered amines. Exemplary sterically hindered bis-phenols may be, for example, 2,2'-methylenebis(4-ethyl-6-tert-butylphenol). Exemplary sterically hindered dihydroquinones can be, for example, 2,5-di(tert-amyl)hydroquinone or 4,4'-thiobis(6-tert-butyl-o-cresol and 2,5-di(tert-amyl)hydroquinone. Exemplary sterically hindered amines can be, for example, 4,4'-[4-diethylamino)phenyl]methylene]bis(N,N diethyl-3-methylaniline and bis(1,2,2,6,6-pentamethyl-4-piperidinyl)(3,5-di-tert-butyl-4-hydroxybenzyl)butylpropanedioate.

The antioxidant, when present, may be present in the SOF composite in any desired or effective amount, such as up to about 10 percent, or from about 0.25 percent to about 10 percent by weight of the SOF, or up to about 5 percent, such as from about 0.25 percent to about 5 percent by weight of the SOF.

In embodiments, the outer layer of the imaging member may comprise further non-hole-transport-molecule segment in addition to the other segments present in the SOF that are HTMs, such as a first segment of N,N,N',N'-tetra-(p-tolyl) biphenyl-4,4'-diamine, a second segment of N,N,N',N'-tetraphenyl-biphenyl-4,4'-diamine. In such an embodiment, the non-hole-transport-molecule segment would constitute the third segment in the SOF, and may be a fluorinated segment. In embodiments, the SOF may comprise the fluorinated non-hole-transport-molecule segment, in addition one or more segments with hole-transport properties, such as a first segment of N,N,N',N'-tetra-(p-tolyl)biphenyl-4,4'-diamine, and/ or a second segment of N,N,N',N'-tetraphenyl-biphenyl-4,4'-diamine, among other additional segments either with or without hole transport properties (such as a forth, fifth, sixth, seventh, etc., segment). The non-hole-transport-molecule segment, when present, may be present in the SOF in any desired amount, such as up to about 30 percent, or from about 5 percent to about 30 percent by weight of the SOF, or from about 10 percent to about 25 percent by weight of the SOF.

Crosslinking secondary components may also be added to the SOF. Suitable crosslinking secondary components may include melamine monomer or polymer, benzoguanamine-formaldehyde resins, urea-formaldehyde resins, glycoluril-formaldehyde resins, triazine based amino resins and combinations thereof. Typical amino resins include the melamine resins manufactured by CYTEC such as Cymel 300, 301, 303, 325 350, 370, 380, 1116 and 1130; benzoguananiine resins such as Cymel R 1123 and 1125; glycoluril resins such as Cymel 1170, 1171, and 1172 and urea resins such as CYMEL U-14-160-BX, CYMEL UI-20-E.

In embodiments, the secondary components may have similar or disparate properties to accentuate or hybridize (synergistic effects or ameliorative effects as well as the ability to attenuate inherent or inclined properties of the capped SOF) the intended property of the SOF to enable it to meet performance targets. For example, doping the SOFs with antioxidant compounds will extend the life of the SOF by preventing chemical degradation pathways. Additionally, additives maybe added to improve the morphological properties of the SOF by tuning the reaction occurring during the promotion of the change of the reaction mixture to form the SOF.

Process Action B: Depositing the Reaction Mixture as a Wet Film

The reaction mixture may be applied as a wet film to a variety of substrates using a number of liquid deposition techniques. The thickness of the SOF is dependant on the thickness of the wet film and the molecular building block loading in the reaction mixture. The thickness of the wet film is dependent on the viscosity of the reaction mixture and the method used to deposit the reaction mixture as a wet film.

Substrates include, for example, polymers, papers, metals and metal alloys, doped and undoped forms of elements from Groups III-VI of the periodic table, metal oxides, metal chalcogenides, and previously prepared SOFs or capped SOFs. Examples of polymer film substrates include polyesters, polyolefins, polycarbonates, polystyrenes, polyvinylchloride, block and random copolymers thereof, and the like. Examples of metallic surfaces include metallized polymers, metal foils, metal plates; mixed material substrates such as metals patterned or deposited on polymer, semiconductor, metal oxide, or glass substrates. Examples of substrates comprised of doped and undoped elements from Groups III-VI of the periodic table include, aluminum, silicon, silicon n-doped with phosphorous, silicon p-doped with boron, tin, gallium arsenide, lead, gallium indium phosphide, and indium. Examples of metal oxides include silicon dioxide, titanium dioxide, indium tin oxide, tin dioxide, selenium dioxide, and alumina. Examples of metal chalcogenides include cadmium sulfide, cadmium telluride, and zinc selenide. Additionally, it is appreciated that chemically treated or mechanically modified forms of the above substrates remain within the scope of surfaces which may be coated with the reaction mixture.

In embodiments, the substrate may be composed of, for example, silicon, glass plate, plastic film or sheet. For structurally flexible devices, a plastic substrate such as polyester, polycarbonate, polyimide sheets and the like may be used. The thickness of the substrate may be from around 10 micrometers to over 10 millimeters with an exemplary thickness being from about 50 to about 100 micrometers, especially for a flexible plastic substrate, and from about 1 to about 10 millimeters for a rigid substrate such as glass or silicon.

The reaction mixture may be applied to the substrate using a number of liquid deposition techniques including, for example, spin coating, blade coating, web coating, dip coating, cup coating, rod coating, screen printing, ink jet printing, spray coating, stamping and the like. The method used to deposit the wet layer depends on the nature, size, and shape of the substrate and the desired wet layer thickness. The thickness of the wet layer can range from about 10 nm to about 5 mm, such as from about 100 nm to about 1 mm, or from about 1 μm to about 500 μm.

Process Action C: Promoting the Change of Wet Film to the Dry SOF

The term "promoting" refers, for example, to any suitable technique to facilitate a reaction of the molecular building blocks, such as a chemical reaction of the functional groups of the building blocks. In the case where a liquid needs to be removed to form the dry film, "promoting" also refers to removal of the liquid. Reaction of the molecular building blocks (and optionally capping units), and removal of the liquid can occur sequentially or concurrently. In embodiments, the capping unit and/or secondary component may be added while the promotion of the change of the wet film to the dry SOF is occurring. In certain embodiments, the liquid is also one of the molecular building blocks and is incorporated into the SOF. The term "dry SOF" refers, for example, to substantially dry SOFs (such as capped and/or composite SOFs), for example, to a liquid content less than about 5% by weight of the SOF, or to a liquid content less than 2% by weight of the SOF.

Promoting the wet layer to form a dry SOF may be accomplished by any suitable technique. Promoting the wet layer to form a dry SOF typically involves thermal treatment including, for example, oven drying, infrared radiation (IR), and the like with temperatures ranging from 40 to 350° C. and from 60 to 200° C. and from 85 to 160° C. The total heating time can range from about four seconds to about 24 hours, such as from one minute to 120 minutes, or from three minutes to 60 minutes.

IR promotion of the wet layer to the COF film may be achieved using an IR heater module mounted over a belt transport system. Various types of IR emitters may be used, such as carbon IR emitters or short wave IR emitters (available from Heraerus). Additional exemplary information regarding carbon IR emitters or short wave IR emitters is summarized in Table 1 below.

TABLE 1

Exemplary information regarding carbon or short wave IR emitters

| IR lamp | Peak Wavelength | Number of lamps | Module Power (kW) |
|---|---|---|---|
| Carbon | 2.0 micron | 2 - twin tube | 4.6 |
| Short wave | 1.2-1.4 micron | 3 - twin tube | 4.5 |

Process Action D: Optionally Removing the SOF from the Coating Substrate to Obtain a Free-Standing SOF In embodiments, a free-standing SOF is desired. Free-standing SOFs may be obtained when an appropriate low adhesion substrate is used to support the deposition of the wet layer. Appropriate substrates that have low adhesion to the SOF may include, for example, metal foils, metalized polymer substrates, release papers and SOFs, such as SOFs prepared with a surface that has been altered to have a low adhesion or a decreased propensity for adhesion or attachment. Removal of the SOF from the supporting substrate may be achieved in a number of ways by someone skilled in the art. For example, removal of the SOF from the substrate may occur by starting from a corner or edge of the film and optionally assisted by passing the substrate and SOF over a curved surface.

Process Action E: Optionally Processing the Free-Standing SOF into a Roll

Optionally, a free-standing SOF or a SOF supported by a flexible substrate may be processed into a roll. The SOF may be processed into a roll for storage, handling, and a variety of other purposes. The starting curvature of the roll is selected such that the SOF is not distorted or cracked during the rolling process.

Process Action F: Optionally Cutting and Seaming the SOF into a Shape, Such as a Belt The method for cutting and seaming the SOF is similar to that described in U.S. Pat. No. 5,455,136 issued on Oct. 3, 1995 (for polymer films), the disclosure of which is herein totally incorporated by reference. An SOF belt may be fabricated from a single SOF, a multi layer SOF or an SOF sheet cut from a web. Such sheets may be rectangular in shape or any particular shape as desired. For example, the SOF(s) may be fabricated into shapes, such as a belt by overlap joining the opposite marginal end regions of the SOF sheet, by known methods.

Process Action G: Optionally Using a SOF as a Substrate for Subsequent SOF Formation Processes A SOF may be used as a substrate in the SOF forming process to afford a multi-layered structured organic film. The layers of a multi-layered SOF may be chemically bound in or in physical contact. Chemically bound, multi-layered SOFs are formed when functional groups present on the substrate SOF surface can react with the molecular building blocks present in the deposited wet layer used to form the second structured organic film layer. Multi-layered SOFs in physical contact may not chemically bound to one another.

Applications of SOFs in Imaging Members, Such as Photoreceptor Layers

Figure 2:
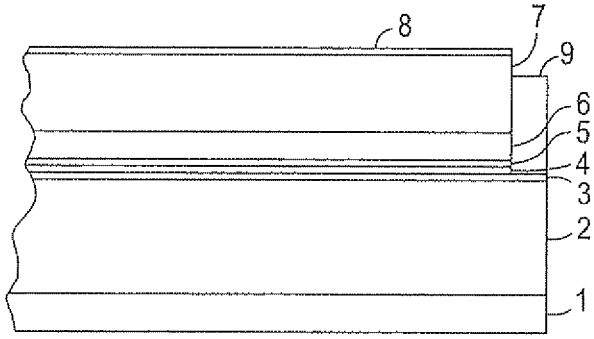
FIG. 2 represents a simplified side view of an exemplary photoreceptor that incorporates a SOF of the present disclosure.
Figure 3:
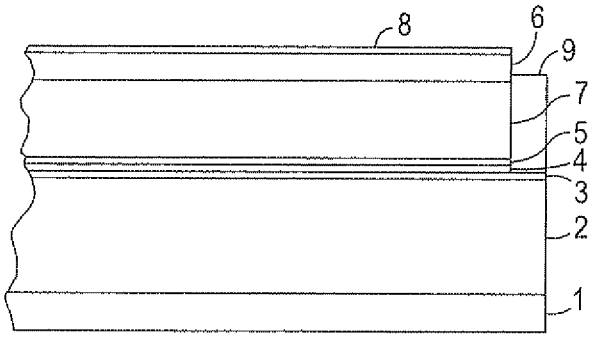
FIG. 3 represents a simplified side view of a second exemplary photoreceptor that incorporates a SOF of the present disclosure.
Figure 4:
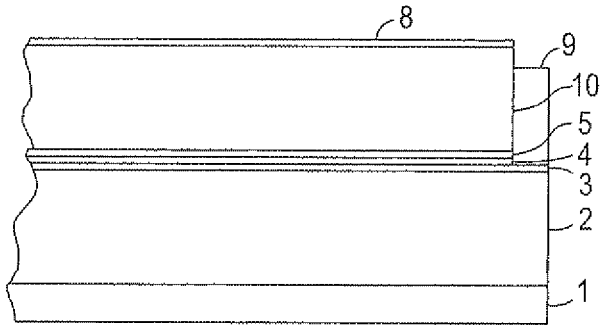
FIG. 4 represents a simplified side view of a third exemplary photoreceptor that incorporates a SOF of the present disclosure.

Representative structures of an electrophotographic imaging member (e.g., a photoreceptor) are shown in FIGS. 2-4. These imaging members are provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9. In FIG. 4, imaging layer 10 (containing both charge generating material and charge transport material) takes the place of separate charge generating layer 6 and charge transport layer 7.

As seen in the figures, in fabricating a photoreceptor, a charge generating material (CGM) and a charge transport material (CTM) may be deposited onto the substrate surface either in a laminate type configuration where the CGM and CTM are in different layers (e.g., FIGS. 2 and 3) or in a single layer configuration where the CGM and CTM are in the same layer (e.g., FIG. 4). In embodiments, the photoreceptors may be prepared by applying over the electrically conductive layer the charge generation layer 6 and, optionally, a charge transport layer 7. In embodiments, the charge generation layer and, when present, the charge transport layer, may be applied in either order.

Anti Curl Layer

For some applications, an optional anti-curl layer 1, which comprises film-forming organic or inorganic polymers that are electrically insulating or slightly semi-conductive, may be provided. The anti-curl layer provides flatness and/or abrasion resistance.

Anti-curl layer 1 may be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the anti-curl layer in the range of about 0.5 to about 40 weight percent of the anti-curl layer. Additives include organic and inorganic particles that may further improve the wear resistance and/or provide charge relaxation property. Organic particles include Teflon powder, carbon black, and graphite particles. Inorganic particles include insulating and semiconducting metal oxide particles such as silica, zinc oxide, tin oxide and the like. Another semiconducting additive is the oxidized oligomer salts as described in U.S. Pat. No. 5,853,906. The oligomer salts are oxidized N,N,N',N'-tetra-p-tolyl-4,4'-biphenyldiamine salt.

The thickness of the anti-curl layer is typically from about 3 micrometers to about 35 micrometers, such as from about 10 micrometers to about 20 micrometers, or about 14 micrometers.

The Supporting Substrate

As indicated above, the photoreceptors are prepared by first providing a substrate 2, i.e., a support. The substrate may be opaque or substantially transparent and may comprise any additional suitable material(s) having given required mechanical properties, such as those described in U.S. Pat. Nos. 4,457,994; 4,871,634; 5,702,854; 5,976,744; and 7,384,717 the disclosures of which are incorporated herein by reference in their entireties.

The substrate may comprise a layer of electrically non-conductive material or a layer of electrically conductive material, such as an inorganic or organic composition. If a non-conductive material is employed, it may be necessary to provide an electrically conductive ground plane over such non-conductive material. If a conductive material is used as the substrate, a separate ground plane layer may not be necessary.

The substrate may be flexible or rigid and may have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins may be used as electrically non-conducting materials, including, for example, polyesters, polycarbonates, polyamides, polyurethanes, and the like. Such a substrate may comprise a commercially available biaxially oriented polyester known as MYLAR™, available from E. I. duPont de Nemours & Co., MELINEX™, available from TCI Americas Inc., or HOSTAPHAN™, available from American Hoechst Corporation. Other materials of which the substrate may be comprised include polymeric materials, such as polyvinyl fluoride, available as TEDLAR™ from E. I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor may also be coated on an insulating plastic drum, provided a conducting ground plane has previously been coated on its surface, as described above. Such substrates may either be seamed or seamless.

When a conductive substrate is employed, any suitable conductive material may be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum may be used, as well as the conducting metal drum made from a material such as aluminum.

The thickness of the substrate depends on numerous factors, including the required mechanical performance and economic considerations. The thickness of the substrate is typically within a range of from about 65 micrometers to about 150 micrometers, such as from about 75 micrometers to about 125 micrometers for optimum flexibility and minimum induced surface bending stress when cycled around small diameter rollers, e.g., 19 mm diameter rollers. The substrate for a flexible belt may be of substantial thickness, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1-6 mm.

The surface of the substrate to which a layer is to be applied may be cleaned to promote greater adhesion of such a layer. Cleaning may be effected, for example, by exposing the surface of the substrate layer to plasma discharge, ion bombardment, and the like. Other methods, such as solvent cleaning, may also be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Electrically Conductive Ground Plane

As stated above, in embodiments, the photoreceptors prepared comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate may act as the conductive layer, although a conductive ground plane may also be provided.

If an electrically conductive ground plane is used, it is positioned over the substrate. Suitable materials for the electrically conductive ground plane include, for example, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium may be used.

The ground plane may be applied by known coating techniques, such as solution coating, vapor deposition, and sputtering. A method of applying an electrically conductive ground plane is by vacuum deposition. Other suitable methods may also be used.

In embodiments, the thickness of the ground plane may vary over a substantially wide range, depending on the optical transparency and flexibility desired for the electrophotoconductive member. For example, for a flexible photoresponsive imaging device, the thickness of the conductive layer may be between about 20 angstroms and about 750 angstroms; such as, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 may be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized.

If a blocking layer is employed, it may be positioned over the electrically conductive layer. The term "over," as used herein in connection with many different types of layers, should be understood as not being limited to instances wherein the layers are contiguous. Rather, the term "over" refers, for example, to the relative placement of the layers and encompasses the inclusion of unspecified intermediate layers.

The blocking layer 4 may include polymers such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387; 4,286,033; and 4,291,110 the disclosures of which are incorporated herein by reference in their entireties.

The blocking layer may be continuous and may have a thickness ranging, for example, from about 0.01 to about 10 micrometers, such as from about 0.05 to about 5 micrometers.

The Adhesive Layer

An intermediate layer 5 between the blocking layer and the charge generating layer may, if desired, be provided to promote adhesion. However, in embodiments, a dip coated aluminum drum may be utilized without an adhesive layer.

Additionally, adhesive layers may be provided, if necessary, between any of the layers in the photoreceptors to ensure adhesion of any adjacent layers. Alternatively, or in addition, adhesive material may be incorporated into one or both of the respective layers to be adhered. Such optional adhesive layers may have thicknesses of about 0.001 micrometer to about 0.2 micrometer. Such an adhesive layer may be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E. I. duPont de Nemours & Co.), Vitel PE-100 (available from Goodyear Tire and Rubber Co.), polyvinyl butyral, polyvinyl pyrrolidone, polyurethane, polymethyl methacrylate, and the like. The adhesive layer may be composed of a polyester with a $M_w$ of from about 50,000 to about 100,000, such as about 70,000, and a $M_n$ of about 35,000.

The Imaging Layer(s)

The imaging layer refers to a layer or layers containing charge generating material, charge transport material, or both the charge generating material and the charge transport material.

Either a n-type or a p-type charge generating material may be employed in the photoreceptors of the present disclosure.

In the case where the charge generating material and the charge transport material are in different layers—for example a charge generation layer and a charge transport layer—the charge transport layer may comprise a SOF comprising fluorinated secondary components dispersed therein. Further, in the case where the charge generating material and the charge transport material are in the same layer, this layer may comprise a SOF comprising fluorinated secondary components dispersed therein, which may be a composite and/or capped SOF.

Charge Generation Layer

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

For multilayered photoreceptors comprising a charge generating layer (also referred herein as a photoconductive layer) and a charge transport layer, satisfactory results may be achieved with a dried photoconductive layer coating thickness of between about 0.1 micrometer and about 10 micrometers. In embodiments, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges may be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer, a non-polymeric material, or a SOF comprising fluorinated secondary components dispersed therein, which may be a composite and/or capped SOF, capable of supporting the injection of photoexcited holes or transporting electrons from the photoconductive material and allowing the transport of these holes or electrons through the organic layer to selectively dissipate a surface charge.

Organic Polymer Charge Transport Layer

Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly(vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonyffluorenemalononitrile.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

In a charge transport layer, the weight ratio of the charge transport material ("CTM") to the binder ranges from 30 (CTM):70 (binder) to 70 (CTM):30 (binder).

Any suitable technique may be utilized to apply the charge transport layer and the charge generating layer to the substrate. Typical coating techniques include dip coating, roll coating, spray coating, rotary atomizers, and the like. The coating techniques may use a wide concentration of solids. The solids content is between about 2 percent by weight and 30 percent by weight based on the total weight of the dispersion. The expression "solids" refers, for example, to the charge transport particles and binder components of the charge transport coating dispersion. These solids concentrations are useful in dip coating, roll, spray coating, and the like. Generally, a more concentrated coating dispersion may be used for roll coating. Drying of the deposited coating may be effected by any suitable conventional technique such as oven drying, infra-red radiation drying, air drying and the like. Generally, the thickness of the transport layer is between about 5 micrometers to about 100 micrometers, but thicknesses outside these ranges can also be used. In general, the ratio of the thickness of the charge transport layer to the charge generating layer is maintained, for example, from about 2:1 to 200:1 and in some instances as great as about 400:1.

SOF Charge Transport Layer

Illustrative charge transport SOFs include for example a positive hole transporting material selected from compounds having a segment containing a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport SOF segments include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; and 1,4-bromopyrene. Suitable electron transport SOF segments include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, see U.S. Pat. No. 4,921,769. Other hole transporting SOF segments include arylamines described in U.S. Pat. No. 4,265,990, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport SOF segments may be selected, reference for example U.S. Pat. Nos. 4,921,773 and 4,464,450.

Generally, the thickness of the charge transport SOF layer is between about 5 micrometers to about 100 micrometers, such as about 10 micrometers to about 70 micrometers or 10 micrometers to about 40 micrometers. In general, the ratio of the thickness of the charge transport layer to the charge generating layer may be maintained from about 2:1 to 200:1 and in some instances as great as 400:1.

Single Layer P/R—Organic Polymer

The materials and procedures described herein may be used to fabricate a single imaging layer type photoreceptor containing a binder, a charge generating material, and a charge transport material. For example, the solids content in the dispersion for the single imaging layer may range from about 2% to about 30% by weight, based on the weight of the dispersion.

Where the imaging layer is a single layer combining the functions of the charge generating layer and the charge transport layer, illustrative amounts of the components contained therein are as follows: charge generating material (about 5% to about 40% by weight), charge transport material (about 20% to about 60% by weight), and binder (the balance of the imaging layer).

Single Layer P/R—SOF

The materials and procedures described herein may be used to fabricate a single imaging layer type photoreceptor containing a charge generating material and a charge transport SOF including fluorinated secondary components. For example, the solids content in the dispersion for the single imaging layer may range from about 2% to about 60% by weight, based on the weight of the dispersion.

Where the imaging layer is a single layer combining the functions of the charge generating layer and the charge transport layer, illustrative amounts of the components contained therein are as follows: charge generating material (about 2% to about 40% by weight), with an inclined added functionality of charge transport molecular building block (about 20% to about 75% by weight).

The Overcoating Layer

Embodiments in accordance with the present disclosure further include an overcoating layer or layers 8, which, if employed, are positioned over the charge generation layer or over the charge transport layer. This layer may comprise SOFs comprising fluorinated secondary components dispersed therein.

Such a protective overcoating layer includes a fluorinated SOF including fluorinated secondary components forming reaction mixture containing a plurality of molecular building blocks that optionally contain charge transport segments.

In embodiments, there is provided a process for preparing an outer layer of an imaging member, the imaging member comprising a substrate, an imaging layer disposed on the substrate, and an outer layer disposed on the imaging layer, wherein the process comprises providing an imaging member comprising a substrate and an imaging layer disposed on the substrate, providing a outer layer solution comprising a liquid-containing reaction mixture including a plurality of molecular building blocks, each comprising a segment (where at least one segment may comprise fluorine and at least one of the resulting segments is electroactive, such as an HTM) and a number of functional groups, and optionally a pre-SOF, and dispersing fluorinated secondary components with a dispersants to obtain a suspension (or dispersion) in solvent and mixing the suspension (or dispersion) with the reaction mixture comprising a plurality of molecular building blocks, and applying the outer layer solution onto the imaging layer to form an outer layer comprising fluorinated secondary components dispersed therein. In embodiments, the process may further comprise crosslinking and/or thermal curing of various molecular entities included in the SOF.

In embodiments, a optional secondary component and additives, such as an additional charge transport compound, may be added to the SOF in addition to the fluorinated secondary components, such polytetrafluoroethylene particles (which may have a core-shell structure) that may be present in an amount greater than 1% by weight of total weight of the outer layer (or SOF), such as from about 2% to about 30% by weight of total weight of the outer layer (or SOF), or from about 5% to about 25% by weight of total weight of the outer layer (or SOF).

In embodiments, the combined total of secondary components and additives may be present in the overcoating layer in the range of about 0.5 to about 40 weight percent of the overcoating layer. In embodiments, additives include organic and inorganic particles which can further improve the wear resistance and/or provide charge relaxation property. In embodiments, organic particles include Teflon powder, carbon black, and graphite particles. In embodiments, inorganic particles include insulating and semiconducting metal oxide particles such as silica, zinc oxide, tin oxide and the like. Another semiconducting additive is the oxidized oligomer salts as described in U.S. Pat. No. 5,853,906 the disclosure of which is incorporated herein by reference in its entirety. In embodiments, oligomer salts are oxidized N,N,N', N'-tetra-p-tolyl-4,4'-biphenyldiamine salt.

Overcoating layers from about 2 micrometers to about 15 micrometers, such as from about 3 micrometers to about 8 micrometers are effective in preventing charge transport molecule leaching, crystallization, and charge transport layer cracking in addition to providing scratch and wear resistance.

The Ground Strip

The ground strip 9 may comprise a film-forming binder and electrically conductive particles. Cellulose may be used to disperse the conductive particles. Any suitable electrically conductive particles may be used in the electrically conductive ground strip layer 8. The ground strip 8 may, for example, comprise materials that include those enumerated in U.S. Pat. No. 4,664,995 the disclosure of which is incorporated herein by reference in its entirety. Typical electrically conductive particles include, for example, carbon black, graphite, copper, silver, gold, nickel, tantalum, chromium, zirconium, vanadium, niobium, indium tin oxide, and the like.

The electrically conductive particles may have any suitable shape. Typical shapes include irregular, granular, spherical, elliptical, cubic, flake, filament, and the like. In embodiments, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers, such as from about 14 micrometers to about 27 micrometers.

In embodiments, an imaging member may comprise a SOF of the present disclosure as the surface layer (OCL or CTL). This imaging member may be a fluorinated SOF that comprises one or more fluorinated segments and N,N,N',N'-tetra-(methylenephenylene)biphenyl-4,4'-diamine and/or N,N,N', N'-tetraphenyl-terphenyl-4,4'-diamine segments. For example, the first fluorinated segment may be a segment of the following formula:

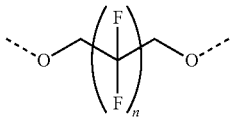

where n is an integer from about 2 to about 60, such as from about 4 to about 24, or about 8 to about 20.

In embodiments, imaging member may comprise a fluorinated SOF layer (including fluorinated secondary components), where the thickness of the SOF layer may be any desired thickness, such as up to about 30 microns, or between about 1 and about 15 microns. For example, the outermost layer may be an overcoat layer, and the overcoat layer comprising the SOF may be from about 1 to about 20 microns thick, such as about 2 to about 10 microns. In embodiments, such an SOF may comprise fluorinated secondary components, a first fluorinated segment and second electroactive segment wherein the ratio of the first fluorinated segment to the second electroactive segment is from about 5:1 to about 0.2:1, such as about 3.5:1 to about 0.5:1, or as about 1.5:1 to about 0.75:1. In embodiments, the second electroactive segment may be present in the SOF of the outermost layer in an amount from about 20 to about 80 percent by weight of the SOF, such as from about 25 to about 75 percent by weight of the SOF, or from about 35 to about 70 percent by weight of the SOF. In embodiments, the SOF, which may be a composite and/or capped SOF, in such an imaging member may be a single layer or two or more layers. In a specific embodiments, the SOF in such an imaging member does not comprise a secondary component selected from the groups consisting of antioxidants and acid scavengers.

In embodiments, a SOF may be incorporated into various components of an image forming apparatus. For example, a SOF may be incorporated into a electrophotographic photoreceptor, a contact charging device, an exposure device, a developing device, a transfer device and/or a cleaning unit. In embodiments, such an image forming apparatus may be equipped with an image fixing device, and a medium to which an image is to be transferred is conveyed to the image fixing device through the transfer device.

The contact charging device may have a roller-shaped contact charging member. The contact charging member may be arranged so that it comes into contact with a surface of the photoreceptor, and a voltage is applied, thereby being able to give a specified potential to the surface of the photoreceptor. In embodiments, a contact charging member may be formed from a SOF and or a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber.

Further, a covering layer, optionally comprising an SOF of the present disclosure, may also be provided on a surface of the contact charging member of embodiments. In order to further adjust resistivity, the SOF may be a composite SOF or a capped SOF or a combination thereof, and in order to prevent deterioration, the SOF may be tailored to comprise an antioxidant either bonded or added thereto.

The resistance of the contact-charging member of embodiments may in any desired range, such as from about 10° to about $10^{14}$ Ωcm, or from about $10^{2}$ to about $10^{12}$ Ωcm. When a voltage is applied to this contact-charging member, either a DC voltage or an AC voltage may be used as the applied voltage. Further, a superimposed voltage of a DC voltage and an AC voltage may also be used.

In an exemplary apparatus, the contact-charging member, optionally comprising an SOF, such as a composite and/or capped SOF, of the contact-charging device may be in the shape of a roller. However, such a contact-charging member may also be in the shape of a blade, a belt, a brush or the like.

In embodiments an optical device that can perform desired imagewise exposure to a surface of the electrophotographic photoreceptor with a light source such as a semiconductor laser, an LED (light emitting diode) or a liquid crystal shutter, may be used as the exposure device.

In embodiments, a known developing device using a normal or reversal developing agent of a one-component system, a two-component system or the like may be used in embodiments as the developing device. There is no particular limitation on image forming material (such as a toner, ink or the like, liquid or solid) that may be used in embodiments of the disclosure.

Contact type transfer charging devices using a belt, a roller, a film, a rubber blade or the like, or a scorotron transfer charger or a scorotron transfer charger utilizing corona discharge may be employed as the transfer device, in various embodiments. In embodiments, the charging unit may be a biased charge roll, such as the biased charge rolls described in U.S. Pat. No. 7,177,572 entitled "A Biased Charge Roller with Embedded Electrodes with Post-Nip Breakdown to Enable Improved Charge Uniformity," the total disclosure of which is hereby incorporated by reference in its entirety.

Further, in embodiments, the cleaning device may be a device for removing a remaining image forming material, such as a toner or ink (liquid or solid), adhered to the surface of the electrophotographic photoreceptor after a transfer step, and the electrophotographic photoreceptor repeatedly subjected to the above-mentioned image formation process may be cleaned thereby. In embodiments, the cleaning device may be a cleaning blade, a cleaning brush, a cleaning roll or the like.

Materials for the Cleaning Blade Include SOFs or Urethane Rubber, Neoprene Rubber and Silicone Rubber In an exemplary image forming device, the respective steps of charging, exposure, development, transfer and cleaning are conducted in turn in the rotation step of the electrophotographic photoreceptor, thereby repeatedly performing image formation. The electrophotographic photoreceptor may be provided with specified layers comprising SOFs and photosensitive layers that comprise the desired SOF, and thus photoreceptors having excellent discharge gas resistance, mechanical strength, scratch resistance, particle dispersibility, etc., may be provided. Accordingly, even in embodiments in which the photoreceptor is used together with the contact charging device or the cleaning blade, or further with spherical toner obtained by chemical polymerization, good image quality may be obtained without the occurrence of image defects such as fogging. That is, embodiments of the invention provide image-forming apparatuses that can stably provide good image quality for a long period of time is realized.

A number of examples of the process used to make SOFs are set forth herein and are illustrative of the different compositions, conditions, techniques that may be utilized. Identified within each example are the nominal actions associated with this activity. The sequence and number of actions along with operational parameters, such as temperature, time, coating method, and the like, are not limited by the following examples. All proportions are by weight unless otherwise indicated. The term "rt" refers, for example, to temperatures ranging from about 20° C. to about 25° C.

Given the examples below it will be apparent, that the compositions prepared by the methods of the present disclosure may be practiced with many types of components and may have many different uses in accordance with the disclosure above and as pointed out hereinafter.

EXAMPLES

Example 1

Action A

Preparation of the Liquid Containing Reaction Mixture

The following were combined: the building block dodecafluoro-1,8-octanediol [segment=dodecafluoro-1,8-octyl; Fg=hydroxyl (—OH); (14.85 g)], a second building block N4,N4,N4',N4'-tetrakis(4-(methoxymethyl)phenyl)biphenyl-4,4'-diamine [segment=N4,N4,N4',N4'-tetra-p-tolylbiphenyl-4,4'-diamine; Fg=methoxy ether (—$OCH_3$); (8.25 g)], BNX-TAHQ (1.5 g), an acid catalyst (Nacure XP-357; 1.5 mg) to yield the liquid containing reaction mixture, a leveling additive (Silclean 3700; 1.2 g), and 42.5 g of 1-methoxy-2-propanol. The mixture was mixed on a rolling wave rotator for 10 minutes and then heated at 75° C. for 1.5 hours until a homogenous solution resulted. The mixture was cooled, and then filtered through a 0.45 micron PTFE membrane.

A 15% PTFE dispersion was prepared by dissolving GF-400 (5% m/m with respect to PTFE particles; 225 mg) in 1-methoxy-2-propanol (25.5 g), sonicating for 30 minutes at 25° C., then adding PTFE particles (4.5 g) and sonicating for 90 minutes at 25° C. This dispersion (30 g) was added to SOF reaction mixture and the combined mixture was sonicated for 90 minutes at 25° C. The reaction mixture was stirred at room temperature for one hour before coating.

Action B

Deposition of Reaction Mixture as a Wet Film

The reaction mixture was applied to a commercially available, 30 mm and 40 mm drum photoreceptors using a cup coater (Tsukiage coating) at a pull-rate of 240 mm/min.

Action C

Promotion of the Change of the Wet Film to a Dry SOF

The photoreceptor drum supporting the wet layer was rapidly transferred to an actively vented oven preheated to 55° C. and left to heat for 40 min. These actions provided a film having a thickness of 2.6 microns.

Devices coated with the fluorinated SOF over coat layers of Example 1 possess electrical properties (PIDC) comparable to conventional overcoat layers as well as the non-fluorinated overcoat with PTFE.

Wear Rate (accelerated photoreceptor wear fixture): Photoreceptor surface wear was evaluated using a Xerox F469 CRU drum/toner cartridge. The surface wear is determined by the change in thickness of the photoreceptor after 50,000 cycles in the F469 CRU with cleaning blade and single component toner. The thickness was measured using a Permascope ECT-100 at one inch intervals from the top edge of the coating along its length. All of the recorded thickness values were averaged to obtain and average thickness of the entire photoreceptor device. The change in thickness after 50,000 cycles was measured in nanometers and then divided by the number of kcycles to obtain the wear rate in nanometers per kcycle. This accelerated photoreceptor wear fixture achieves much higher wear rates than those observed in an actual machine used in a xerographic system, where wear rates are generally five to ten times lower depending on the xerographic system.

Wear rates of approximately 23.6 nm/kcycle were obtained, which is almost half that of the non-fluorinated overcoat formulation with 15% PTFE (Formulation: 27.5% N4,N4,N4',N4'-tetrakis(4-(methoxymethyl)phenyl)biphenyl-4,4'-diamine, 49.5% N,N'-diphenyl-N,N'-bis-(3-hydroxyphenyl)-biphenyl-4,4'-diamine, 1% Cymel 303, 5% BNX-TAHQ, and 15% PTFE particles which had a measured wear rate of ~44 nm/kcycle.

Fluorinated SOF overcoat layers containing fluorinated particles, demonstrated in the above examples are designed as ultra-low wear layers and have a further benefit of reducing negative interactions (reducing the torque) with the cleaning blade that leads to photoreceptor drive motor failure compared to their non-fluorinated counterparts (i.e. overcoat layers prepared with alkyldiols in place of fluoro-alkyldiols), frequently observed in BCR charging systems. Fluorinated SOF over coat layers containing fluorinated particles can be coated without any processes adjustments onto existing substrates and have excellent electrical characteristics.

It will be appreciated that several of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a substrate;

a charge generating layer;

a charge transport layer; and an optional overcoat layer, wherein the outermost layer is an imaging surface that comprises a structured organic film (SOF) comprising a plurality of segments and a plurality of linkers including a first fluorinated segment, a second electroactive segment and fluorinated secondary components having a size in the range of from 100 nm to 5000 nm.

2. The imaging member of claim 1, wherein the fluorinated secondary components are selected from a group consisting of polytetrafluoroethylene (PTFE), perfluoroalkoxy polymer resin (PFA), a copolymers of tetrafluoroethylene (TFE) and hexafluoropropylene (HFP), a copolymers of hexafluoropropylene (HFP) and vinylidene fluoride (VDF), a copolymers of hexafluoropropylene (HFP) and vinylidene fluoride (VF2), a terpolymers of tetrafluoroethylene (TFE), vinylidene fluoride (VDF), and hexafluoropropylene (HFP), and a tetrapolymers of tetrafluoroethylene (TFE), vinylidene fluoride (VF2), hexafluoropropylene (HFP), and mixtures thereof.

3. The imaging member of claim 1, wherein the fluorinated secondary components comprise polytetrafluoroethylene (PTFE) particles.

4. The imaging member of claim 1, wherein the outermost layer is an overcoat layer, and the overcoat layer is from about 2 to about 10 microns thick.

5. The imaging member of claim 1, wherein the outermost layer is a charge transport layer, and the charge transport layer is from about 15 to about 40 microns thick.

6. The imaging member of claim 1, wherein the outmost layer is a capped SOF.

7. The imaging member of claim 6, wherein the capped SOF comprises a capping group is obtained from a fluorinated alcohol having from about 5 to about 60 carbon atoms, or at least one compound of the general formula $CF_3(CF_2)_x(OH)$ where x is in the range of from about 5 to about 60.

8. The imaging member of claim 1, wherein the first fluorinated segment is present in the SOF of the outermost layer in an amount from about 15% to about 60% by weight of the SOF.

9. The imaging member of claim 1, wherein the second electroactive segment is selected from the group consisting of N,N,N',N'-tetra-(p-tolyl)biphenyl-4,4'-diamine:

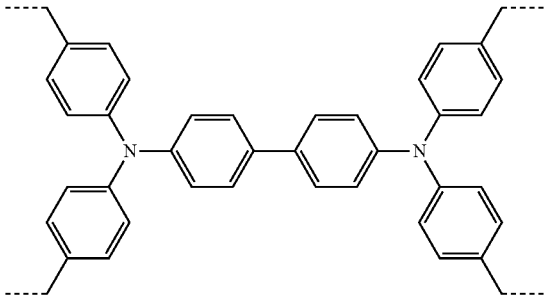

and N4,N4'-bis(3,4-dimethylphenyl)-N4,N4'-di-p-tolyl-[1,1'-biphenyl]-4,4'-diamine:

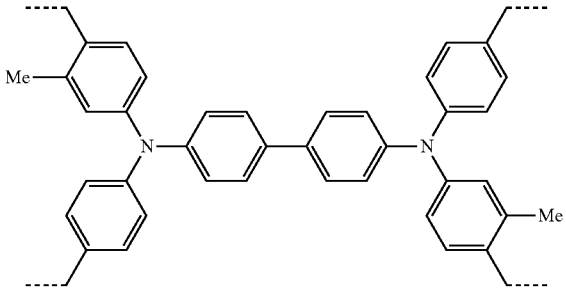

and tris (4 hydroxymethyl)triphenylamine:

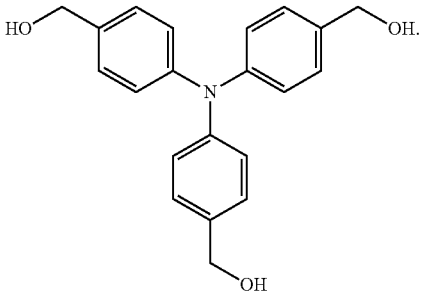

10. The imaging member of claim 1, wherein second electroactive segment is present in the SOF of the outermost layer in an amount from about 20% to about 75% by weight of the SOF.

11. The imaging member of claim 1, wherein the fluorine content of the SOF is from about 20% to about 65% by weight of the SOF.

12. The imaging member of claim 1, wherein the first fluorinated segment and the second electroactive segment are present in the SOF of the outermost layer in an amount of from about 65% to about 97% by weight of the SOF.

13. The imaging member of claim 1, wherein the fluorinated secondary components are present in the SOF in an amount up to about 35% by weight of the SOF.

14. The imaging member of claim 1, wherein the SOF further comprises a secondary component selected from the group consisting of melamine/formaldehyde compounds, and melamine/formaldehyde resins in an amount from about 1 up to about 35 percent by weight of the SOF.

15. The imaging member of claim 14, wherein the fluorinated secondary components are fluorinated particles with a fluoro-polymer core and a shell comprising melamine resins, formaldehyde resins, or a combination thereof.

16. The imaging member of claim 15, wherein the fluoropolymer core is selected from the group consisting of polytetrafluoroethylene, perfluoroalkoxy polymer resin, a copolymer of tetrafluoroethylene and hexafluoropropylene, a copolymers of hexafluoropropylene and vinylidene fluoride, a copolymers of hexafluoropropylene and vinylidene fluoride, a terpolymers of tetrafluoroethylene, vinylidene fluoride, and hexafluoropropylene, and a tetrapolymers of tetrafluoroethylene, vinylidene fluoride, and hexafluoropropylene.

17. A xerographic apparatus comprising the imaging member of claim 1, wherein the imaging member possesses a wear rate of from about 1 to about 30 nanometers per kilocycle rotation.

18. The imaging member of claim 1, wherein the first fluorinated segment is obtained from a fluorinated building block selected from the group consisting of 2,2,3,3,4,4,5,5-octafluoro-1,6-hexanediol, 2,2,3,3,4,4,5,5,6,6,7,7-dodecanfluoro-1,8-octanediol, 2,2,3,3,4,4,5,5,6,6,7,7,8,8,9,9-perfluorodecane-1,10-diol, and 2,2,3,3,4,4,5,5,6,6,7,7,8,8-tetradecafluoro-1,9-nonanediol.

19. The imaging member of claim 1, comprising an overcoat layer, wherein the ratio of the first fluorinated segment to the second electroactive segment is from about 3.5:1 to about 0.5:1.

* * * * *